US011764522B2

(12) United States Patent
Hsu et al.

(10) Patent No.: US 11,764,522 B2
(45) **Date of Patent: *Sep. 19, 2023**

(54) SMT RECEPTACLE CONNECTOR WITH SIDE LATCHING

(71) Applicant: Amphenol East Asia Ltd., Taoyuan (TW)

(72) Inventors: Wen Te (Hank) Hsu, Taoyuan (TW); Sheng-Fen Sang, Taoyuan (TW)

(73) Assignee: Amphenol East Asia Ltd., Taoyuan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/216,463

(22) Filed: Mar. 29, 2021

(65) Prior Publication Data

US 2021/0218195 A1 Jul. 15, 2021

Related U.S. Application Data

(63) Continuation of application No. 16/695,062, filed on Nov. 25, 2019, now Pat. No. 10,965,064.
(Continued)

(30) Foreign Application Priority Data

Apr. 22, 2019 (TW) ..... 108204949

(51) Int. Cl.
*H01R 13/648* (2006.01)
*H01R 13/6581* (2011.01)
(Continued)

(52) U.S. Cl.
CPC ..... *H01R 13/6581* (2013.01); *H01R 12/707* (2013.01); *H01R 12/7052* (2013.01);
(Continued)

(58) Field of Classification Search
CPC ..... H01R 13/6581; H01R 13/502; H01R 13/6273; H01R 13/631; H01R 13/6594;
(Continued)

(56) References Cited

U.S. PATENT DOCUMENTS 2,996,710 A 8/1961 Pratt
3,002,162 A 9/1961 Garstang
(Continued)

FOREIGN PATENT DOCUMENTS

CN 1175101 A 3/1998
CN 1192068 A 9/1998
(Continued)

OTHER PUBLICATIONS

Chinese communication for Chinese Application No. 201580014851.4, dated Jun. 1, 2020.
(Continued)

*Primary Examiner* — Harshad C Patel
(74) *Attorney, Agent, or Firm* — Wolf, Greenfield & Sacks, P.C.

(57) ABSTRACT

A receptacle connector having a plurality of airflow holes positioned to avoid heat buildup inside a receptacle shell, preventing deformation to the housing of a short, high density connector during solder reflow. The airflow holes may be in a bent portion joining a top face and rear face of the shell. The receptacle connector may be mounted to a substrate, such as a printed circuit board, leaving a gap between the connector and the substrate, forming an airflow passage between the substrate and the receptacle connector, enabling heated air to reach mounting portions of terminals of the connector during soldering, but reducing heat buildup within the shell. The passage, alone or in combination with a cutout in a face of the shell, may expose terminal contacts of the receptacle connector to provide for easy inspection
(Continued)

and rework of the solder joints between the terminal contacts and the substrate.

19 Claims, 22 Drawing Sheets

Related U.S. Application Data

(60) Provisional application No. 62/864,470, filed on Jun. 20, 2019.

(51) Int. Cl.

| | |
|---|---|
| ***H01R 13/6594*** | (2011.01) |
| ***H01R 12/70*** | (2011.01) |
| ***H01R 43/02*** | (2006.01) |
| ***H01R 13/631*** | (2006.01) |
| ***H01R 12/72*** | (2011.01) |
| ***H01R 13/627*** | (2006.01) |
| ***H01R 12/71*** | (2011.01) |
| ***H01R 13/502*** | (2006.01) |
| ***H01R 43/20*** | (2006.01) |

(52) U.S. Cl.
CPC ..... *H01R 12/716* (2013.01); *H01R 12/724* (2013.01); *H01R 12/727* (2013.01); *H01R 13/502* (2013.01); *H01R 13/6273* (2013.01); *H01R 13/631* (2013.01); *H01R 13/6594* (2013.01); *H01R 43/0256* (2013.01); *H01R 43/20* (2013.01)

(58) Field of Classification Search
CPC H01R 43/0256; H01R 43/20; H01R 12/7052; H01R 12/707; H01R 12/716; H01R 12/724; H01R 12/727; H01R 13/658; H01R 13/648
See application file for complete search history.

(56) References Cited

U.S. PATENT DOCUMENTS

| | | | |
|---|---|---|---|
| 3,134,950 | A | 5/1964 | Cook |
| 3,322,885 | A | 5/1967 | May et al. |
| 3,530,422 | A | 9/1970 | Goodman |
| 3,631,381 | A | 12/1971 | Pittman |
| 3,786,372 | A | 1/1974 | Epis et al. |
| 3,825,874 | A | 7/1974 | Peverill |
| 3,863,181 | A | 1/1975 | Glance et al. |
| 3,977,757 | A | 8/1976 | Yurtin |
| 4,155,613 | A | 5/1979 | Brandeau |
| 4,195,272 | A | 3/1980 | Boutros |
| 4,276,523 | A | 6/1981 | Boutros et al. |
| 4,286,837 | A | 9/1981 | Yasutake et al. |
| 4,371,742 | A | 2/1983 | Manly |
| 4,408,255 | A | 10/1983 | Adkins |
| 4,447,105 | A | 5/1984 | Ruehl |
| 4,471,015 | A | 9/1984 | Ebneth et al. |
| 4,484,159 | A | 11/1984 | Whitley |
| 4,490,283 | A | 12/1984 | Kleiner |
| 4,518,651 | A | 5/1985 | Wolfe, Jr. |
| 4,519,664 | A | 5/1985 | Tillotson |
| 4,519,665 | A | 5/1985 | Althouse et al. |
| 4,632,476 | A | 12/1986 | Schell |
| 4,636,752 | A | 1/1987 | Saito |
| 4,682,129 | A | 7/1987 | Bakermans et al. |
| 4,687,267 | A | 8/1987 | Header et al. |
| 4,728,762 | A | 3/1988 | Roth et al. |
| 4,751,479 | A | 6/1988 | Parr |
| 4,761,147 | A | 8/1988 | Gauthier |
| 4,787,548 | A | 11/1988 | Abbagnaro et al. |
| 4,806,107 | A | 2/1989 | Arnold et al. |
| 4,846,724 | A | 7/1989 | Sasaki et al. |
| 4,846,727 | A | 7/1989 | Glover et al. |
| 4,871,316 | A | 10/1989 | Herrell et al. |
| 4,878,155 | A | 10/1989 | Conley |
| 4,948,922 | A | 8/1990 | Varadan et al. |
| 4,970,354 | A | 11/1990 | Iwasa et al. |
| 4,975,084 | A | 12/1990 | Fedder et al. |
| 4,992,060 | A | 2/1991 | Meyer |
| 5,000,700 | A | 3/1991 | Masubuchi et al. |
| 5,041,023 | A | 8/1991 | Lytle |
| 5,066,236 | A | 11/1991 | Broeksteeg |
| 5,141,454 | A | 8/1992 | Garrett et al. |
| 5,150,086 | A | 9/1992 | Ito |
| 5,166,527 | A | 11/1992 | Solymar |
| 5,168,252 | A | 12/1992 | Naito |
| 5,168,432 | A | 12/1992 | Murphy et al. |
| 5,171,161 | A | 12/1992 | Kachlic |
| 5,176,538 | A | 1/1993 | Hansell, III et al. |
| 5,266,055 | A | 11/1993 | Naito et al. |
| 5,280,257 | A | 1/1994 | Cravens et al. |
| 5,287,076 | A | 2/1994 | Johnescu et al. |
| 5,334,050 | A | 8/1994 | Andrews |
| 5,340,334 | A | 8/1994 | Nguyen |
| 5,346,410 | A | 9/1994 | Moore, Jr. |
| 5,429,520 | A | 7/1995 | Morlion et al. |
| 5,429,521 | A | 7/1995 | Morlion et al. |
| 5,433,617 | A | 7/1995 | Morlion et al. |
| 5,433,618 | A | 7/1995 | Morlion et al. |
| 5,456,619 | A | 10/1995 | Belopolsky et al. |
| 5,461,392 | A | 10/1995 | Mott et al. |
| 5,474,472 | A | 12/1995 | Niwa et al. |
| 5,484,310 | A | 1/1996 | McNamara et al. |
| 5,496,183 | A | 3/1996 | Soes et al. |
| 5,499,935 | A | 3/1996 | Powell |
| 5,551,893 | A | 9/1996 | Johnson |
| 5,562,497 | A | 10/1996 | Yagi et al. |
| 5,597,328 | A | 1/1997 | Mouissie |
| 5,651,702 | A | 7/1997 | Hanning et al. |
| 5,669,789 | A | 9/1997 | Law |
| 5,796,323 | A | 8/1998 | Uchikoba et al. |
| 5,810,623 | A | 9/1998 | Regnier et al. |
| 5,831,491 | A | 11/1998 | Buer et al. |
| 5,885,088 | A | 3/1999 | Brennan et al. |
| 5,924,899 | A | 7/1999 | Paagman |
| 5,981,869 | A | 11/1999 | Kroger |
| 5,982,253 | A | 11/1999 | Perrin et al. |
| 5,993,259 | A | 11/1999 | Stokoe et al. |
| 6,019,616 | A | 2/2000 | Yagi et al. |
| 6,152,747 | A | 11/2000 | McNamara |
| 6,168,469 | B1 | 1/2001 | Lu |
| 6,174,202 | B1 | 1/2001 | Mitra |
| 6,174,203 | B1 | 1/2001 | Asao |
| 6,174,944 | B1 | 1/2001 | Chiba et al. |
| 6,217,372 | B1 | 4/2001 | Reed |
| 6,293,827 | B1 | 9/2001 | Stokoe |
| 6,296,491 | B1 | 10/2001 | Pickles |
| 6,296,496 | B1 | 10/2001 | Trammel |
| 6,299,438 | B1 | 10/2001 | Sahagian et al. |
| 6,299,483 | B1 | 10/2001 | Cohen et al. |
| 6,315,615 | B1 | 11/2001 | Raistrick |
| 6,322,395 | B1 | 11/2001 | Nishio et al. |
| 6,328,601 | B1 | 12/2001 | Yip et al. |
| 6,347,962 | B1 | 2/2002 | Kline |
| 6,350,134 | B1 | 2/2002 | Fogg et al. |
| 6,361,363 | B1 | 3/2002 | Hwang |
| 6,364,711 | B1 | 4/2002 | Berg et al. |
| 6,375,510 | B2 | 4/2002 | Asao |
| 6,379,188 | B1 | 4/2002 | Cohen et al. |
| 6,394,842 | B1 | 5/2002 | Sakurai et al. |
| 6,398,588 | B1 | 6/2002 | Bickford |
| 6,409,543 | B1 | 6/2002 | Astbury, Jr. et al. |
| 6,447,170 | B1 | 9/2002 | Takahashi et al. |
| 6,482,017 | B1 | 11/2002 | Van Doorn |
| 6,503,103 | B1 | 1/2003 | Cohen et al. |
| 6,506,076 | B2 | 1/2003 | Cohen et al. |
| 6,517,360 | B1 | 2/2003 | Cohen |
| 6,530,790 | B1 | 3/2003 | McNamara et al. |
| 6,537,087 | B2 | 3/2003 | McNamara et al. |
| 6,540,559 | B1 | 4/2003 | Kemmick et al. |
| 6,551,140 | B2 | 4/2003 | Billman et al. |
| 6,554,647 | B1 | 4/2003 | Cohen et al. |

(56) References Cited

U.S. PATENT DOCUMENTS 6,565,387 B2 5/2003 Cohen
6,565,390 B2 5/2003 Wu
6,579,116 B2 6/2003 Brennan et al.
6,582,244 B2 6/2003 Fogg et al.
6,592,381 B2 7/2003 Cohen et al.
6,595,801 B1 7/2003 Leonard et al.
6,595,802 B1 7/2003 Watanabe et al.
6,602,095 B2 8/2003 Astbury, Jr. et al.
6,607,402 B2 8/2003 Cohen et al.
6,609,922 B2 8/2003 Torii
6,616,864 B1 9/2003 Jiang et al.
6,652,318 B1 11/2003 Winings et al.
6,652,319 B1 11/2003 Billman
6,655,966 B2 12/2003 Rothermel et al.
6,709,294 B1 3/2004 Cohen et al.
6,713,672 B1 3/2004 Stickney
6,726,492 B1 4/2004 Yu
6,743,057 B2 6/2004 Davis et al.
6,749,463 B1 6/2004 Fan
6,776,659 B1 8/2004 Stokoe et al.
6,786,771 B2 9/2004 Gailus
6,808,420 B2 10/2004 Whiteman, Jr. et al.
6,814,619 B1 11/2004 Stokoe et al.
6,830,489 B2 12/2004 Aoyama
6,872,085 B1 3/2005 Cohen et al.
6,875,031 B1 4/2005 Korsunsky et al.
6,932,649 B1 8/2005 Rothermel et al.
6,979,202 B2 12/2005 Benham et al.
6,979,226 B2 12/2005 Otsu et al.
6,986,681 B2 * 1/2006 Tsai ..... H01R 12/716 439/607.37
7,008,267 B2 3/2006 Fan
7,044,794 B2 5/2006 Consoli et al.
7,057,570 B2 6/2006 Irion, II et al.
7,074,086 B2 7/2006 Cohen et al.
7,086,872 B2 8/2006 Myer et al.
7,094,102 B2 8/2006 Cohen et al.
7,104,842 B1 9/2006 Huang et al.
7,108,556 B2 9/2006 Cohen et al.
7,156,672 B2 1/2007 Fromm et al.
7,163,421 B1 1/2007 Cohen et al.
7,232,344 B1 6/2007 Gillespie et al.
7,285,018 B2 10/2007 Kenny et al.
7,316,585 B2 1/2008 Smith et al.
7,318,740 B1 1/2008 Henry et al.
7,320,614 B2 1/2008 Toda et al.
7,322,845 B2 1/2008 Regnier et al.
7,331,822 B2 * 2/2008 Chen n ..... H01R 23/6873 439/607.01
7,335,063 B2 2/2008 Cohen et al.
7,364,464 B2 4/2008 Iino et al.
7,371,117 B2 5/2008 Gailus
7,407,413 B2 8/2008 Minich
7,467,977 B1 12/2008 Yi et al.
7,473,124 B1 1/2009 Briant et al.
7,494,383 B2 2/2009 Cohen et al.
7,540,781 B2 6/2009 Kenny et al.
7,581,990 B2 9/2009 Kirk et al.
7,588,464 B2 9/2009 Kim
7,604,502 B2 10/2009 Pan
7,645,165 B2 1/2010 Wu et al.
7,690,946 B2 4/2010 Knaub et al.
7,699,644 B2 4/2010 Szczesny et al.
7,722,401 B2 5/2010 Kirk et al.
7,727,027 B2 6/2010 Chiang et al.
7,727,028 B1 6/2010 Zhang et al.
7,731,537 B2 6/2010 Amleshi et al.
7,731,541 B1 6/2010 Lee et al.
7,753,731 B2 7/2010 Cohen et al.
7,771,233 B2 8/2010 Gailus
7,789,676 B2 9/2010 Morgan et al.
7,794,240 B2 9/2010 Cohen et al.
7,794,278 B2 9/2010 Cohen et al.
7,806,729 B2 10/2010 Nguyen et al.
7,824,192 B2 11/2010 Lin et al.
7,871,296 B2 1/2011 Fowler et al.
7,874,873 B2 1/2011 Do et al.
7,883,369 B1 2/2011 Sun et al.
7,887,371 B2 2/2011 Kenny et al.
7,887,379 B2 2/2011 Kirk
7,906,730 B2 3/2011 Atkinson et al.
7,914,304 B2 3/2011 Cartier et al.
7,946,889 B2 5/2011 Mizumura
7,985,097 B2 7/2011 Gulla
7,993,147 B2 8/2011 Cole et al.
8,018,733 B2 9/2011 Jia
8,083,553 B2 12/2011 Manter et al.
8,123,544 B2 2/2012 Kobayashi
8,142,207 B1 3/2012 Ljubijankic et al.
8,182,289 B2 5/2012 Stokoe et al.
8,215,968 B2 7/2012 Cartier et al.
8,216,001 B2 7/2012 Kirk
8,262,411 B2 9/2012 Kondo
8,272,877 B2 9/2012 Stokoe et al.
8,337,247 B2 * 12/2012 Zhu ..... H01R 13/6582 439/607.19
8,348,701 B1 1/2013 Lan et al.
8,371,875 B2 2/2013 Gailus
8,382,524 B2 2/2013 Khilchenko et al.
8,440,637 B2 5/2013 Elmen
8,480,432 B2 7/2013 Wu
8,506,319 B2 8/2013 Ritter et al.
8,506,331 B2 8/2013 Wu
8,545,253 B2 10/2013 Amidon et al.
8,550,861 B2 10/2013 Cohen et al.
8,597,051 B2 12/2013 Yang et al.
8,657,627 B2 2/2014 McNamara et al.
8,715,003 B2 5/2014 Buck et al.
8,715,005 B2 5/2014 Pan
8,740,637 B2 6/2014 Wang et al.
8,764,492 B2 7/2014 Chiang
8,771,016 B2 7/2014 Atkinson et al.
8,864,506 B2 10/2014 Little et al.
8,864,521 B2 10/2014 Atkinson et al.
8,905,777 B2 12/2014 Zhu et al.
8,926,377 B2 1/2015 Kirk et al.
8,944,831 B2 2/2015 Stoner et al.
8,968,034 B2 3/2015 Hsu
8,998,642 B2 4/2015 Manter et al.
9,004,942 B2 4/2015 Paniagua
9,011,177 B2 4/2015 Lloyd et al.
9,022,806 B2 5/2015 Cartier, Jr. et al.
9,028,281 B2 5/2015 Kirk et al.
9,065,230 B2 6/2015 Milbrand, Jr.
9,124,009 B2 9/2015 Atkinson et al.
9,166,317 B2 10/2015 Briant et al.
9,219,335 B2 12/2015 Atkinson et al.
9,225,085 B2 12/2015 Cartier, Jr. et al.
9,246,253 B1 * 1/2016 Defibaugh ..... H01R 12/523
9,257,778 B2 2/2016 Buck et al.
9,257,794 B2 2/2016 Wanha et al.
9,263,835 B2 2/2016 Guo
9,281,590 B1 3/2016 Liu et al.
9,287,668 B2 3/2016 Chen et al.
9,300,074 B2 3/2016 Gailus
9,337,585 B1 5/2016 Yang
9,350,095 B2 5/2016 Arichika et al.
9,431,734 B2 * 8/2016 Guo ..... H01R 13/405
9,450,344 B2 9/2016 Cartier, Jr. et al.
9,484,674 B2 11/2016 Cartier, Jr. et al.
9,509,101 B2 11/2016 Cartier, Jr. et al.
9,520,686 B2 12/2016 Hu et al.
9,520,689 B2 12/2016 Cartier, Jr. et al.
9,531,130 B1 12/2016 Phillips et al.
9,537,250 B2 1/2017 Kao et al.
9,640,915 B2 5/2017 Phillips et al.
9,692,183 B2 6/2017 Phillips et al.
9,742,132 B1 8/2017 Hsueh
9,831,605 B2 11/2017 Buck et al.
9,843,135 B2 12/2017 Guetig et al.
9,887,485 B2 2/2018 Lambie et al.
9,935,385 B2 4/2018 Phillips et al.
9,972,945 B1 5/2018 Huang et al.
9,997,853 B2 * 6/2018 Little ..... H01R 13/64

(56) References Cited

U.S. PATENT DOCUMENTS 9,997,871 B2 6/2018 Zhong et al.
10,050,369 B1 8/2018 Yang
10,122,129 B2 11/2018 Milbrand, Jr. et al.
10,135,197 B2 11/2018 Little et al.
10,211,577 B2 2/2019 Milbrand, Jr. et al.
10,243,304 B2 3/2019 Kirk et al.
10,270,191 B1 4/2019 Li et al.
10,276,995 B2 4/2019 Little
10,283,910 B1 5/2019 Chen et al.
10,320,102 B2 6/2019 Phillips et al.
10,320,125 B2 * 6/2019 Ju ..... H01R 12/724
10,348,040 B2 7/2019 Cartier, Jr. et al.
10,381,767 B1 8/2019 Milbrand, Jr. et al.
10,431,936 B2 10/2019 Horning et al.
10,439,311 B2 10/2019 Phillips et al.
10,511,128 B2 12/2019 Kirk et al.
10,541,482 B2 1/2020 Sasame et al.
10,573,987 B2 2/2020 Osaki et al.
10,601,181 B2 3/2020 Lu et al.
10,680,387 B2 * 6/2020 Cheng ..... H01R 24/60
10,714,875 B2 * 7/2020 Wan ..... H01R 13/6582
10,741,944 B2 8/2020 Long
10,777,921 B2 9/2020 Lu et al.
10,797,446 B2 10/2020 Liu et al.
10,826,214 B2 11/2020 Phillips et al.
10,833,437 B2 11/2020 Huang et al.
10,840,622 B2 11/2020 Sasame et al.
10,855,020 B1 12/2020 Phillips et al.
10,950,961 B2 3/2021 Lai et al.
10,965,064 B2 * 3/2021 Hsu ..... H01R 43/0256
11,146,025 B2 10/2021 Lu et al.
11,189,971 B2 11/2021 Lu
11,264,755 B2 3/2022 Te
11,381,015 B2 7/2022 Lu
11,444,397 B2 9/2022 Sasame et al.
11,588,277 B2 2/2023 Jiang
2001/0012730 A1 8/2001 Ramey et al.
2001/0042632 A1 11/2001 Manov et al.
2001/0046810 A1 11/2001 Cohen et al.
2002/0042223 A1 4/2002 Belopolsky et al.
2002/0061671 A1 5/2002 Torii
2002/0089464 A1 7/2002 Joshi
2002/0098738 A1 7/2002 Astbury et al.
2002/0111068 A1 8/2002 Cohen et al.
2002/0111069 A1 8/2002 Astbury et al.
2002/0123266 A1 9/2002 Ramey et al.
2002/0132518 A1 9/2002 Kobayashi
2002/0146926 A1 10/2002 Fogg et al.
2003/0119360 A1 6/2003 Jiang et al.
2003/0220018 A1 11/2003 Winings et al.
2004/0005815 A1 1/2004 Mizumura et al.
2004/0020674 A1 2/2004 McFadden et al.
2004/0058572 A1 3/2004 Fromm et al.
2004/0115968 A1 6/2004 Cohen
2004/0121652 A1 6/2004 Gailus
2004/0171305 A1 9/2004 McGowan et al.
2004/0196112 A1 10/2004 Welbon et al.
2004/0235352 A1 11/2004 Takemasa
2004/0259419 A1 12/2004 Payne et al.
2005/0042928 A1 2/2005 Yi et al.
2005/0048818 A1 3/2005 Pan
2005/0048838 A1 3/2005 Korsunsky et al.
2005/0048842 A1 3/2005 Benham et al.
2005/0070160 A1 3/2005 Cohen et al.
2005/0133245 A1 6/2005 Katsuyama et al.
2005/0176835 A1 8/2005 Kobayashi et al.
2005/0233610 A1 10/2005 Tutt et al.
2005/0283974 A1 12/2005 Richard et al.
2005/0287869 A1 12/2005 Kenny et al.
2006/0019525 A1 1/2006 Lloyd et al.
2006/0068640 A1 3/2006 Gailus
2006/0166560 A1 7/2006 Shuey et al.
2006/0255876 A1 11/2006 Kushta et al.
2006/0276082 A1 12/2006 Hung et al.
2006/0292932 A1 12/2006 Benham et al.
2007/0004282 A1 1/2007 Cohen et al.
2007/0004828 A1 1/2007 Khabbaz
2007/0021000 A1 1/2007 Laurx
2007/0021001 A1 1/2007 Laurx et al.
2007/0021002 A1 1/2007 Laurx et al.
2007/0021003 A1 1/2007 Laurx et al.
2007/0021004 A1 1/2007 Laurx et al.
2007/0037419 A1 2/2007 Sparrowhawk
2007/0042639 A1 2/2007 Manter et al.
2007/0054554 A1 3/2007 Do et al.
2007/0059961 A1 3/2007 Cartier et al.
2007/0155241 A1 7/2007 Lappohn
2007/0173118 A1 7/2007 Chen
2007/0197063 A1 8/2007 Ngo et al.
2007/0218765 A1 9/2007 Cohen et al.
2007/0243764 A1 10/2007 Liu et al.
2007/0293084 A1 12/2007 Ngo
2008/0020640 A1 1/2008 Zhang et al.
2008/0194146 A1 8/2008 Gailus
2008/0246555 A1 10/2008 Kirk et al.
2008/0248658 A1 10/2008 Cohen et al.
2008/0248659 A1 10/2008 Cohen et al.
2008/0248660 A1 10/2008 Kirk et al.
2009/0011641 A1 1/2009 Cohen et al.
2009/0011645 A1 1/2009 Laurx et al.
2009/0035955 A1 2/2009 McNamara
2009/0061661 A1 3/2009 Shuey et al.
2009/0117386 A1 5/2009 Vacanti et al.
2009/0203259 A1 8/2009 Nguyen et al.
2009/0239395 A1 9/2009 Cohen et al.
2009/0258516 A1 10/2009 Hiew et al.
2009/0291593 A1 11/2009 Atkinson et al.
2009/0305530 A1 12/2009 Ito et al.
2009/0305533 A1 12/2009 Feldman et al.
2009/0305553 A1 12/2009 Thomas et al.
2010/0048058 A1 2/2010 Morgan et al.
2010/0068934 A1 3/2010 Li et al.
2010/0075538 A1 3/2010 Ohshida
2010/0081302 A1 4/2010 Atkinson et al.
2010/0112846 A1 5/2010 Kotaka
2010/0124851 A1 5/2010 Xiong et al.
2010/0144167 A1 6/2010 Fedder et al.
2010/0203772 A1 8/2010 Mao et al.
2010/0291806 A1 11/2010 Minich et al.
2010/0294530 A1 11/2010 Atkinson et al.
2011/0003509 A1 1/2011 Gailus
2011/0067237 A1 3/2011 Cohen et al.
2011/0104948 A1 5/2011 Girard, Jr. et al.
2011/0130038 A1 6/2011 Cohen et al.
2011/0136388 A1 6/2011 Fu et al.
2011/0143605 A1 6/2011 Pepe
2011/0212649 A1 9/2011 Stokoe et al.
2011/0212650 A1 9/2011 Amleshi et al.
2011/0230095 A1 9/2011 Atkinson et al.
2011/0230096 A1 9/2011 Atkinson et al.
2011/0256739 A1 10/2011 Toshiyuki et al.
2011/0287663 A1 11/2011 Gailus et al.
2012/0094536 A1 4/2012 Khilchenko et al.
2012/0156929 A1 6/2012 Manter et al.
2012/0184145 A1 7/2012 Zeng
2012/0184154 A1 7/2012 Frank et al.
2012/0202363 A1 8/2012 McNamara et al.
2012/0202386 A1 8/2012 McNamara et al.
2012/0202387 A1 8/2012 McNamara
2012/0214344 A1 8/2012 Cohen et al.
2013/0012038 A1 1/2013 Kirk et al.
2013/0017733 A1 1/2013 Kirk et al.
2013/0065454 A1 3/2013 Milbrand, Jr.
2013/0078870 A1 3/2013 Milbrand, Jr.
2013/0078871 A1 3/2013 Milbrand, Jr.
2013/0090001 A1 4/2013 Kagotani
2013/0109232 A1 5/2013 Paniaqua
2013/0143442 A1 6/2013 Cohen et al.
2013/0196553 A1 8/2013 Gailus
2013/0217263 A1 8/2013 Pan
2013/0225006 A1 8/2013 Khilchenko et al.
2013/0237100 A1 9/2013 Affeltranger
2013/0316590 A1 11/2013 Hon
2014/0004724 A1 1/2014 Cartier, Jr. et al.

(56) References Cited

U.S. PATENT DOCUMENTS

| | | | |
|---|---|---|---|
| 2014/0004726 | A1 | 1/2014 | Cartier, Jr. et al. |
| 2014/0004746 | A1 | 1/2014 | Cartier, Jr. et al. |
| 2014/0024263 | A1 | 1/2014 | Dong et al. |
| 2014/0057498 | A1 | 2/2014 | Cohen |
| 2014/0113487 | A1 | 4/2014 | Chen et al. |
| 2014/0273557 | A1 | 9/2014 | Cartier, Jr. et al. |
| 2014/0273627 | A1 | 9/2014 | Cartier, Jr. et al. |
| 2014/0370729 | A1 | 12/2014 | Wang |
| 2014/0377992 | A1 | 12/2014 | Chang et al. |
| 2015/0056856 | A1 | 2/2015 | Atkinson et al. |
| 2015/0072546 | A1 | 3/2015 | Li |
| 2015/0099408 | A1 | 4/2015 | Myer et al. |
| 2015/0111401 | A1 | 4/2015 | Guo |
| 2015/0111427 | A1 | 4/2015 | Foxconn |
| 2015/0126068 | A1 | 5/2015 | Fang |
| 2015/0140866 | A1 | 5/2015 | Tsai et al. |
| 2015/0214673 | A1 | 7/2015 | Gao et al. |
| 2015/0236451 | A1 | 8/2015 | Cartier, Jr. et al. |
| 2015/0236452 | A1 | 8/2015 | Cartier, Jr. et al. |
| 2015/0255904 | A1 | 9/2015 | Ito |
| 2015/0255926 | A1 | 9/2015 | Paniagua |
| 2015/0340798 | A1 | 11/2015 | Kao et al. |
| 2016/0118736 | A1 | 4/2016 | Hoyack et al. |
| 2016/0149343 | A1 | 5/2016 | Atkinson et al. |
| 2016/0268744 | A1 | 9/2016 | Little et al. |
| 2017/0077654 | A1 | 3/2017 | Yao et al. |
| 2017/0302031 | A1 | 10/2017 | Cheng et al. |
| 2017/0352970 | A1 | 12/2017 | Liang et al. |
| 2018/0062323 | A1 | 3/2018 | Kirk et al. |
| 2018/0076555 | A1 | 3/2018 | Scholeno et al. |
| 2018/0145438 | A1 | 5/2018 | Cohen |
| 2018/0198220 | A1 | 7/2018 | Sasame et al. |
| 2018/0205177 | A1 | 7/2018 | Zhou et al. |
| 2018/0212376 | A1 | 7/2018 | Wang et al. |
| 2018/0212385 | A1 | 7/2018 | Little |
| 2018/0219331 | A1 | 8/2018 | Cartier, Jr. et al. |
| 2018/0241156 | A1 | 8/2018 | Huang et al. |
| 2018/0269607 | A1 | 9/2018 | Wu et al. |
| 2018/0331444 | A1 | 11/2018 | Ono |
| 2019/0006778 | A1 | 1/2019 | Fan et al. |
| 2019/0044284 | A1 | 2/2019 | Dunham |
| 2019/0052019 | A1 | 2/2019 | Huang et al. |
| 2019/0067854 | A1 | 2/2019 | Ju et al. |
| 2019/0165518 | A1 | 5/2019 | Hsu et al. |
| 2019/0173209 | A1 | 6/2019 | Lu et al. |
| 2019/0173232 | A1 | 6/2019 | Lu et al. |
| 2019/0214755 | A1 | 7/2019 | Manickam |
| 2019/0334292 | A1 | 10/2019 | Cartier, Jr. et al. |
| 2020/0021052 | A1 | 1/2020 | Milbrand, Jr. et al. |
| 2020/0076131 | A1 | 3/2020 | Hu et al. |
| 2020/0076135 | A1 | 3/2020 | Tang et al. |
| 2020/0153134 | A1 | 5/2020 | Sasame et al. |
| 2020/0161811 | A1 | 5/2020 | Lu |
| 2020/0203865 | A1 | 6/2020 | Wu et al. |
| 2020/0203867 | A1 | 6/2020 | Lu |
| 2020/0203886 | A1 | 6/2020 | Wu et al. |
| 2020/0235529 | A1 | 7/2020 | Kirk et al. |
| 2020/0259294 | A1 | 8/2020 | Lu |
| 2020/0266584 | A1 | 8/2020 | Lu |
| 2020/0328541 | A1 | 10/2020 | Lai et al. |
| 2020/0335914 | A1 | 10/2020 | Hsu et al. |
| 2020/0358226 | A1 | 11/2020 | Lu et al. |
| 2020/0395698 | A1 | 12/2020 | Hou et al. |
| 2020/0403350 | A1 | 12/2020 | Hsu |
| 2021/0036452 | A1 | 2/2021 | Phillips et al. |
| 2021/0050683 | A1 | 2/2021 | Sasame et al. |
| 2021/0135389 | A1 | 5/2021 | Jiang |
| 2021/0135403 | A1 | 5/2021 | Yang et al. |
| 2021/0135404 | A1 | 5/2021 | Jiang |
| 2021/0203104 | A1 | 7/2021 | Chen |
| 2021/0313726 | A1 | 10/2021 | Huang et al. |
| 2021/0351529 | A1 | 11/2021 | Yang et al. |
| 2021/0399449 | A1 | 12/2021 | Guo et al. |
| 2022/0059954 | A1 | 2/2022 | Yue |
| 2022/0069496 | A1 | 3/2022 | Yi et al. |
| 2022/0077632 | A1 | 3/2022 | Chen et al. |
| 2022/0336980 | A1 | 10/2022 | Lu |
| 2022/0360016 | A1 | 11/2022 | Lu et al. |
| 2023/0013147 | A1 | 1/2023 | Lu |

FOREIGN PATENT DOCUMENTS

| | | | |
|---|---|---|---|
| CN | 1275825 | A | 12/2000 |
| CN | 2519434 | Y | 10/2002 |
| CN | 1179448 | C | 12/2004 |
| CN | 1650479 | A | 8/2005 |
| CN | 1799290 | A | 7/2006 |
| CN | 2896615 | Y | 5/2007 |
| CN | 1996678 | A | 7/2007 |
| CN | 2930006 | Y | 8/2007 |
| CN | 101019277 | A | 8/2007 |
| CN | 101176389 | A | 5/2008 |
| CN | 101208837 | A | 6/2008 |
| CN | 101312275 | A | 11/2008 |
| CN | 201323275 | Y | 10/2009 |
| CN | 101600293 | A | 12/2009 |
| CN | 201374434 | Y | 12/2009 |
| CN | 101752700 | A | 6/2010 |
| CN | 101790818 | A | 7/2010 |
| CN | 101120490 | B | 11/2010 |
| CN | 101926055 | A | 12/2010 |
| CN | 201846527 | U | 5/2011 |
| CN | 102106041 | A | 6/2011 |
| CN | 201868621 | U | 6/2011 |
| CN | 102195173 | A | 9/2011 |
| CN | 102224640 | A | 10/2011 |
| CN | 102232259 | A | 11/2011 |
| CN | 102239605 | A | 11/2011 |
| CN | 102292881 | A | 12/2011 |
| CN | 101600293 | B | 5/2012 |
| CN | 102456990 | A | 5/2012 |
| CN | 102487166 | A | 6/2012 |
| CN | 102593661 | A | 7/2012 |
| CN | 102598430 | A | 7/2012 |
| CN | 202395248 | U | 8/2012 |
| CN | 102694318 | A | 9/2012 |
| CN | 102738621 | A | 10/2012 |
| CN | 102859805 | A | 1/2013 |
| CN | 202695788 | U | 1/2013 |
| CN | 202695861 | U | 1/2013 |
| CN | 203445304 | U | 2/2014 |
| CN | 103840285 | A | 6/2014 |
| CN | 203690614 | U | 7/2014 |
| CN | 204030057 | U | 12/2014 |
| CN | 204167554 | U | 2/2015 |
| CN | 104409906 | A | 3/2015 |
| CN | 104577577 | A | 4/2015 |
| CN | 104659573 | A | 5/2015 |
| CN | 204349140 | U | 5/2015 |
| CN | 204577746 | U | 8/2015 |
| CN | 204696287 | U | 10/2015 |
| CN | 105633660 | A | 6/2016 |
| CN | 105703103 | A | 6/2016 |
| CN | 106099546 | A | 11/2016 |
| CN | 107069281 | A | 8/2017 |
| CN | 304240766 | S | 8/2017 |
| CN | 304245430 | S | 8/2017 |
| CN | 206712072 | U | 12/2017 |
| CN | 206712089 | U | 12/2017 |
| CN | 107706632 | A | 2/2018 |
| CN | 207677189 | U | 7/2018 |
| CN | 208078300 | U | 11/2018 |
| CN | 208209042 | U | 12/2018 |
| CN | 208797273 | U | 4/2019 |
| CN | 210326355 | U | 4/2020 |
| CN | 112072400 | A | 12/2020 |
| CN | 212412336 | U | 1/2021 |
| CN | 107706675 | B | 4/2021 |
| CN | 212874843 | U | 4/2021 |
| CN | 113517619 | A | 10/2021 |
| DE | 60216728 | T2 | 11/2007 |
| EP | 0 560 551 | A1 | 9/1993 |
| EP | 0 820 124 | A2 | 1/1998 |
| EP | 1 018 784 | A1 | 7/2000 |

(56) References Cited

FOREIGN PATENT DOCUMENTS

| | | | |
|---|---|---|---|
| EP | 1 779 472 | A1 | 5/2007 |
| EP | 2 169 770 | A2 | 3/2010 |
| EP | 2 405 537 | A1 | 1/2012 |
| GB | 1049435 | A | 11/1966 |
| GB | 1272347 | A | 4/1972 |
| JP | H3-156761 | A2 | 7/1991 |
| JP | H07-302649 | A | 11/1995 |
| JP | 2001-510627 | A | 7/2001 |
| JP | 2002-151190 | A2 | 5/2002 |
| JP | 2006-344524 | A | 12/2006 |
| JP | 2010-129173 | A | 6/2010 |
| MX | 9907324 | A1 | 8/2000 |
| TW | 200835073 | A | 8/2008 |
| TW | M357771 | U | 5/2009 |
| TW | M474278 | U | 3/2014 |
| TW | M502979 | U | 6/2015 |
| TW | I535129 | B | 5/2016 |
| TW | M534922 | U | 1/2017 |
| TW | I596840 | B | 8/2017 |
| TW | M558481 | U | 4/2018 |
| TW | M558482 | U | 4/2018 |
| TW | M558483 | U | 4/2018 |
| TW | M559006 | U | 4/2018 |
| TW | M559007 | U | 4/2018 |
| TW | M560138 | U | 5/2018 |
| TW | M562507 | U | 6/2018 |
| TW | M565894 | Y | 8/2018 |
| TW | M565895 | Y | 8/2018 |
| TW | M565899 | Y | 8/2018 |
| TW | M565900 | Y | 8/2018 |
| TW | M565901 | Y | 8/2018 |
| TW | M605564 | U | 12/2020 |
| TW | M613035 | U | 6/2021 |
| WO | WO 88/05218 | A1 | 7/1988 |
| WO | WO 98/35409 | A1 | 8/1998 |
| WO | WO 2004/059794 | A2 | 7/2004 |
| WO | WO 2004/059801 | A1 | 7/2004 |
| WO | WO 2006/039277 | A1 | 4/2006 |
| WO | WO 2007/005597 | A2 | 1/2007 |
| WO | WO 2007/005599 | A1 | 1/2007 |
| WO | WO 2008/124052 | A2 | 10/2008 |
| WO | WO 2008/124054 | A2 | 10/2008 |
| WO | WO 2008/124057 | A1 | 10/2008 |
| WO | WO 2008/124101 | A2 | 10/2008 |
| WO | WO 2010/030622 | A1 | 3/2010 |
| WO | WO 2010/039188 | A1 | 4/2010 |
| WO | WO 2011/100740 | A2 | 8/2011 |
| WO | WO 2017/007429 | A1 | 1/2017 |

OTHER PUBLICATIONS

Chinese Office Action dated Jan. 18, 2021 in connection with Chinese Application No. 202010031395.7.

Chinese Office Action for Application No. 20168005149LX dated Apr. 30, 2019.

Chinese Office Action for Chinese Application No. 201580014851.4 dated Sep. 4, 2019.

Chinese Office Action for Chinese Application No. 201780064531.9 dated Jan. 2, 2020.

Chinese Office Action for Chinese Application No. 201780097919.9, dated Mar. 10, 2021.

Chinese Office Action for Chinese Application No. 201780097919.9, dated Dec. 3, 2021.

Extended European Search Report dated May 19, 2021 in connection with European Application No. 17930428.2.

Extended European Search Report for European Application No. EP 11166820.8 dated Jan. 24, 2012.

International Preliminary Report on Patentability Chapter II for International Application No. PCT/CN2017/108344 dated Mar. 6, 2020.

International Preliminary Report on Patentability for International Application No. PCT/US2010/056482 dated May 24, 2012.

International Preliminary Report on Patentability for International Application No. PCT/US2011/026139 dated Sep. 7, 2012.

International Preliminary Report on Patentability for International Application No. PCT/US2012/023689 dated Aug. 15, 2013.

International Preliminary Report on Patentability for International Application No. PCT/SG2016/050317 dated Jan. 18, 2018.

International Search Report and Written Opinion for International Application No. PCT/US2010/056482 dated Mar. 14, 2011.

International Search Report and Written Opinion for International Application No. PCT/US2011/026139 dated Nov. 22, 2011.

International Search Report and Written Opinion for International Application No. PCT/US2012/023689 dated Sep. 12, 2012.

International Search Report and Written Opinion for International Application No. PCT/US2012/060610 dated Mar. 29, 2013.

International Search Report and Written Opinion for International Application No. PCT/US2015/012463 dated May 13, 2015.

International Search Report and Written Opinion for International Application No. PCT/US2017/047905 dated Dec. 4, 2017.

International Search Report and Written Opinion for International Application No. PCT/CN2017/108344 dated Aug. 1, 2018.

International Search Report and Written Opinion for International Application No. PCT/US2005/034605 dated Jan. 26, 2006.

International Search Report and Written Opinion for International Application No. PCT/US2011/034747 dated Jul. 28, 2011.

International Search Report and Written Opinion for International Application No. PCT/SG2016/050317 dated Oct. 18, 2016.

International Search Report and Written Opinion dated Jul. 18, 2019 for International Application No. PCT/CN2018/118798.

International Search Report and Written Opinion dated Nov. 29, 2021 for International Application No. PCT/CN2021/114671.

International Search Report with Written Opinion for International Application No. PCT/US2006/025562 dated Oct. 31, 2007.

[No Author Listed], Carbon Nanotubes for Electromagnetic Interference Shielding. SBIR/STTR. Award Information. Program Year 2001. Fiscal Year 2001. Materials Research Institute, LLC. Chu et al. Available at http://sbir.gov/sbirsearch/detail/225895. Last accessed Sep. 19, 2013.

[No Author Listed], High Speed Backplane Connectors. Tyco Electronics. Product Catalog No. 1773095. Revised Dec. 1, 2008—40 pages.

[No Author Listed], MCIO 124pos 85ohm. Amphenol Assembletech. 1 page. URL:http://www.amphenol-ast.com/v3/en/overview.aspx?classId=234 [retrieved on Apr. 11, 2022].

[No Author Listed], Military Fibre Channel High Speed Cable Assembly, www.gore.com.2008. [last accessed Aug. 2, 2012 via Internet Archive: Wayback Machine http://web.archive.org] Link archived: http://www.gore.com/en.sub.--xx/products/cables/copper/networking/militar-y/military.sub.--fibre . . . Last archive date Apr. 6, 2008.

[No Author Listed], Mini Cool Edge IO—The Ideal Solution to Transmit Next Generation High-Speed Signal to Designated Area in Your System. Jul. 25, 2018. 2 pages. URL:https://www.amphenol-icc.com/connect/mini-cool-edge-io-the-ideal-solution-to-transmit-next-generation-high-speedsignal.html [retrieved on Apr. 11, 2022].

[No Author Listed], Mini Cool Edge IO Connector. Commercial IO. Amphenol ICC. 5 pages. URL:https://cdn.amphenol-icc.com/media/wysiwyg/files/documentation/datasheet/inputoutput/io_mini_cool_edge_io.pdf [retrieved on Apr. 11, 2022].

[No Author Listed], SFF-TA-1016 Specification for Internal Unshielded High Speed Connector System. Rev 0.0.1. SNIA SFF TWG Technology Affiliate. Nov. 15, 2019. 40 pages.

Beaman, High Performance Mainframe Computer Cables. 1997 Electronic Components and Technology Conference. 1997;911-7.

Reich et al., Microwave Theory and Techniques. Boston Technical Publishers, Inc. 1965;182-91.

Shi et al. Improving Signal Integrity in Circuit Boards by Incorporating Absorbing Materials. 2001 Proceedings. 51st Electronic Components and Technology Conference, Orlando FL. 2001:1451-56.

European Communication Pursuant to Article 94(3) EPC dated Sep. 8, 2022 for European Application No. 17930428.2.

Taiwanese Office Action dated Jun. 16, 2022 for Taiwan Application No. 107138468.

(56) References Cited

OTHER PUBLICATIONS

Lu, Electrical Connector With a Housing Surrounded by a Shell With Surface Protrusions, U.S. Appl. No. 18/193,552, filed Mar. 30, 2023.
Lu, Electrical Connector With Segments Having Different Widths, U.S. Appl. No. 18/193,555, filed Mar. 30, 2023.
Lu, Multi-Width Electrical Connector With Recessed Neck Segment, U.S. Appl. No. 18/193,561, filed Mar. 30, 2023.
Sasame et al., Electrical connector with cavity between terminals, U.S. Appl. No. 17/942,435, filed Sep. 12, 2022.

* cited by examiner

SMT RECEPTACLE CONNECTOR WITH SIDE LATCHING

CROSS REFERENCE TO RELATED APPLICATIONS

The present application is a continuation of U.S. application Ser. No. 16/695,062, filed on Nov. 25, 2019, entitled "SMT RECEPTACLE CONNECTOR WITH SIDE LATCHING", which claims priority to and the benefit under 35 U.S.C. § 119(e) of U.S. Provisional Patent Application No. 62/864,470, filed on Jun. 20, 2019, and titled "HIGH RELIABILITY SMT RECEPTACLE CONNECTOR." U.S. application Ser. No. 16/695,062 also claims priority to and the benefit of Taiwanese Patent Application No. 108204949, filed on Apr. 22, 2019. The foregoing applications are hereby incorporated by reference in their entirety.

FIELD

This disclosure relates generally to electronic systems and more specifically to miniaturized electrical connectors able to carry high-frequency signals.

BACKGROUND

Electrical connectors are used in many electronic systems. In general, various electronic devices (e.g., smart phones, tablet computers, desktop computers, notebook computers, digital cameras, and the like) have been provided with assorted types of connectors whose primary purpose is to enable an electronic device to exchange data, commands, and/or other signals with one or more other electronic devices. Electrical connectors are basic components needed to make some electrical systems functional. Signal transmission to transfer information (e.g., data, commands, and/or other electrical signals) often utilize electrical connectors between electronic devices, between components of an electronic device, and between electrical systems that may include multiple electronic devices.

It is generally easier and more cost effective to manufacture an electrical system as separate electronic assemblies, such as printed circuit boards ("PCBs"). The PCBs may be connected with electrical connectors that pass electrical signals or power between the PCBs. In some scenarios, the PCBs to be connected may each have connectors mounted on them, which may be mated directly to interconnect the PCBs.

In other scenarios, the PCBs may be connected indirectly via a cable. Electrical connectors may nonetheless be used to make such connections. For example, the cable may be terminated on one or both ends with a plug type of electrical connector ("plug connector" herein). A PCB may be equipped with a board electrical connector, containing an opening ("receptacle connector" herein) into which the plug connector may be inserted to connect the cable to the PCB. A similar arrangement may be used at the other end of the cable, to connect the cable to another PCB, so that signals may pass between the PCBs via the cable.

In some systems, the cable assemblies may route signals between locations near the middle of a PCB and other locations on the PCB. For distances greater than about 6 inches, for example, signal losses within a PCB may interfere with high frequency operation, but a cable of similar length might provide acceptable signal integrity. In these architectures, the receptacle connector might be mounted to the midboard. Such receptacles are generally very small and may be mounted using surface mount solder techniques along with other components to be mounted to the PCB. For surface mounting, a PCB, with components placed on it, is heated. Solder or solder paste between leads of the component and the PCB is heated to a reflow temperature of the solder, which allows the solder to wet the leads on the component and pads on the PCB. When the PCB cools, the solder solidifies, creating bonds between the leads of the component and the PCB.

Connectors are designed to satisfy a range of requirements, including requirements relating to mechanical or electrical performance, cost, reliability and ease of use. For example, connectors may be designed to fit within constrained spaces inside an electronic device and to ensure reliable mating. Additionally, connectors may need to pass signals with high integrity so that operation of the electronic device is not disrupted by unintended changes to signals. Simultaneously satisfying all requirements can be a challenge, particularly for high-speed or high-density interconnections.

For electronic devices that require a high-density, high-speed connector, techniques may be used to reduce interference between conductive elements within the connectors, and to provide other desirable electrical properties. One such technique involves the use of shield members between or around adjacent conductive elements that carry signals through a connector system. The shields may prevent signals carried on one conductive element from creating "crosstalk" on another conductive element. The shields may also have an impact on an impedance of the conductive elements, which may further contribute to desirable electrical properties of the connector system.

Another technique that may be used to control performance characteristics of a connector entails transmitting signals differentially. Differential signals result from signals carried on a pair of conducting paths, called a "differential pair." The voltage difference between the conductive paths represents the differential signal. In general, a differential pair is designed with preferential coupling between the conducting paths of the pair. For example, the two conducting paths of a differential pair may be arranged to run closer to each other than to other adjacent signal paths in the connector.

SUMMARY

Disclosed in the present application is a receptacle connector, comprising: a housing comprising a mating interface for receiving a complementary connector; a plurality of contacts disposed in the housing; a shell at least partially covering the housing, the shell comprising: a rear face; a top face; first and second side faces disposed opposite from each other; a first bent portion disposed between the rear face and the top face and coupling the rear face to the top face; second bent portions disposed between the first and second side faces and the top face and coupling the first and second side faces to the top face; and at least one hole disposed in the first bent portion configured to allow air to flow through.

In some embodiments, the at least one hole comprises a plurality of holes. In some embodiments, the shell comprises a width between the first and second side faces; and the at least one hole extends over at least 80% of the width of the shell. In some embodiments, the shell further comprises first and second openings disposed between the first bent portion and the second bent portions. In some embodiments, the receptacle connector further comprises at least one terminal module disposed in the housing, the at least one terminal module comprising the plurality of contacts.

In some embodiments, the plurality of contacts comprise contact tails configured for connection to a substrate; the housing has a bottom face; and the contact tails extend beyond the bottom face of the housing. In some embodiments, the housing has a bottom face; the housing comprises a plurality of standoffs extending from the bottom face; the first and second side faces of the shell have lower edges; and the plurality of standoffs extend beyond the lower edges of the first and/or second side faces of the shell. In some embodiments, the standoffs extend from the bottom face between 0.2 and 0.4 mm. In some embodiments, the housing comprises a plurality of standoffs extending from a bottom face of the housing; the first and second side faces of the shell have lower edges; and the plurality of standoffs extend beyond the lower edges of the first and/or second side faces of the shell. In some embodiments, the lower edges of the first and second side faces of the shell align with the bottom face.

In some embodiments, the receptacle connector is described in combination with a substrate, wherein the housing comprises a plurality of standoffs extending from a bottom face of the housing, and the receptacle connector is mounted to the substrate with the plurality of standoffs between the bottom face and the substrate such that there is a gap between the shell and the substrate, and the housing and the substrate. In some embodiments, the housing further comprises a front face opposite the rear face of the shell and comprising the mating interface and the gap extends from the front face to the rear face. In some embodiments, the gap extends from the first side face to the second side face. In some embodiments, the substrate is a circuit board and the receptacle connector is surface mount soldered to the printed circuit board.

In some embodiments, the rear face of the shell comprises a lower edge; the contact tails of at least a portion of the plurality of contacts are disposed in a row adjacent to the lower edge of the rear face of the shell; and a first distance, in a direction perpendicular to the bottom face of the housing, between the top face and the lower edge of the rear face of the shell is less than a second distance, in the direction perpendicular to the bottom face of the housing, between the top face and a lower edge of the first or second side faces of the shell. In some embodiments, the difference between the first and second distances is between 0.5 and 1.5 mm. In some embodiments the rear face of the shell comprises a cutout exposing at least a portion of the plurality of contacts.

In some embodiments, the housing comprises a pair of projections disposed on opposing sides of the housing. In some embodiments, the shell further comprises a first hole disposed in the first side face and a second hole disposed in the second side face; wherein the first and second holes are configured to engage with first and second projections of the complementary connector.

In some embodiments, the shell has a height less than 5 mm. In some embodiments, the shell has a height less than 4 mm.

Also disclosed herein is an assembly, comprising a receptacle connector and a substrate, wherein: the receptacle connector is the receptacle connector as described herein; and a bottom face of the housing is mounted to the substrate.

In some embodiments, the substrate is a printed circuit board and the receptacle connector is surface mount soldered to the printed circuit board. In some embodiments, the at least one hole comprises a plurality of holes. In some embodiments, the shell comprises a width between the first and second side faces; and the plurality of holes extend over at least 80% of the width of the shell. In some embodiments, the shell further comprises first and second openings disposed between the first bent portion and the second bent portions. In some embodiments, the plurality of contacts comprise contact tails configured for connection to the printed circuit board; the housing has a bottom face; and the contact tails extend beyond the bottom face of the housing.

In some embodiments, the housing comprises a plurality of standoffs extending from the bottom face; the first and second side faces of the shell have lower edges; and the plurality of standoffs extend beyond the lower edges of the first and/or second side faces of the shell and the bottom face of the housing such that there is a gap between the shell and the printed circuit board, and the housing and the printed circuit board. In some embodiments, the assembly further comprises a front face opposite the rear face of the shell and comprising the mating interface, wherein the gap extends from the front face to the rear face. In some embodiments, the gap extends from the first side face to the second side face.

In some embodiments, the contact tails of at least a portion of the plurality of contacts are disposed in a row adjacent a lower edge of the rear face of the shell; and a first distance, in a direction perpendicular to the top face and the lower edge of the rear face of the shell is less than a second distance, in a direction perpendicular to the bottom face of the housing, between the top face and a lower edge of the first or second side faces of the shell. In some embodiments, the difference between the first and second distances is between 0.5 mm and 1.5 mm. In some embodiments, the contact tails of at least a portion of the plurality of contacts are exposed within a third distance, in a direction perpendicular to the bottom face of the housing, between the lower edge of the rear face of the shell and the printed circuit board.

In some embodiments, the assembly further comprises a plug connector; the plug connector comprising a connector body having a terminal interface for mating with the mating interface of the receptacle connector. In some embodiments, the housing comprises a pair of projections disposed on opposing sides of the housing at an end adjacent to the mating interface; the plug connector further comprises first and second engagement arms; the first engagement arm comprises a first recess; the second engagement arm comprises a second recess; and the first recess is configured to receive a first one of the pair of projections and the second recess is configured to receive a second one of the pair of projections when the plug connector is mated with the receptacle connector.

In some embodiments, the assembly further comprises a high speed electronic component mounted to the printed circuit board adjacent to the receptacle connector; wherein: the receptacle connector is mated with the plug connector. In some embodiments, the high speed electronic component comprises a processor; the assembly further comprises a heat sink mounted to the processor; and the receptacle connector is disposed at least in part below the periphery of the heat sink. In some embodiments, the assembly further comprises an I/O connector; and a cable coupling the plug connector to the I/O connector.

In some embodiments, the shell of the receptacle connector has a height less than 5 mm. In some embodiments, the housing of the receptacle connector comprises a plurality of standoffs extending from a bottom face of the housing, and the receptacle connector is mounted to the printed circuit board with the plurality of standoffs between the bottom face and the printed circuit board such that there is a gap between the shell and the printed circuit board, and the housing and the printed circuit board.

Also disclosed herein is a method of manufacturing an electronic assembly, the method comprising: positioning a receptacle connector on a printed circuit board, wherein: the receptacle connector comprises: a housing comprising a mating interface for receiving a complementary connector; a plurality of contacts disposed in the housing; and a shell at least partially covering the housing, the shell comprising: a rear face; a top face; a first bent portion disposed between the rear face and the top face and coupling the rear face to the top face; flowing heated air over contact tails of the plurality of contacts so as to wet tails of the plurality of contacts and conductive pads on the substrate with solder; and releasing heat from inside the shell through at least one hole disposed in the first bent portion.

In some embodiments, releasing heat comprises air flow through the at least one hole. In some embodiments, flowing heated air over the contact tails comprises flowing the heated air through a gap between the receptacle connector and the substrate. In some embodiments, the at least one hole comprises a plurality of holes. In some embodiments, the shell comprises a width between the first and second side faces; and the at least one hole extends over at least 80% of the width of the shell. In some embodiments, the shell as a height less than 5 mm. In some embodiments, the shell has a height less than 4 mm.

In some embodiments, the gap extends a first distance, in a perpendicular direction from a bottom face of the housing to the substrate, and the first distance has a height between 0.2 mm and 0.4 mm. In some embodiments, the shell further comprises second bent portions disposed between the first and second side faces and the top face and coupling the first and second side faces to the top face, and the shell comprises first and second openings disposed between the first bent portion and the second bent portions.

In some embodiments, the contact tails of at least a portion of the plurality of contacts are disposed in a row adjacent to a lower edge of the rear face of the shell; and a first distance, in a direction perpendicular to a bottom face of the housing, between the top face and the lower edge of the rear face of the shell is less than a second distance, in the direction perpendicular to the bottom face of the housing, between the top face and a lower edge of the first or second side faces of the shell. In some embodiments, the difference between the first and second distances is between 0.5 mm and 1.5 mm.

The foregoing features may be used, separately or together in any combination, in any of the embodiments discussed herein.

BRIEF DESCRIPTION OF DRAWINGS

Various aspects and embodiments of the present technology disclosed herein are described below with reference to the accompanying figures. It should be appreciated that the figures are not necessarily drawn to scale. Items appearing in multiple figures may be indicated by the same reference numeral. For the purposes of clarity, not every component may be labeled in every figure.

Figure 1:
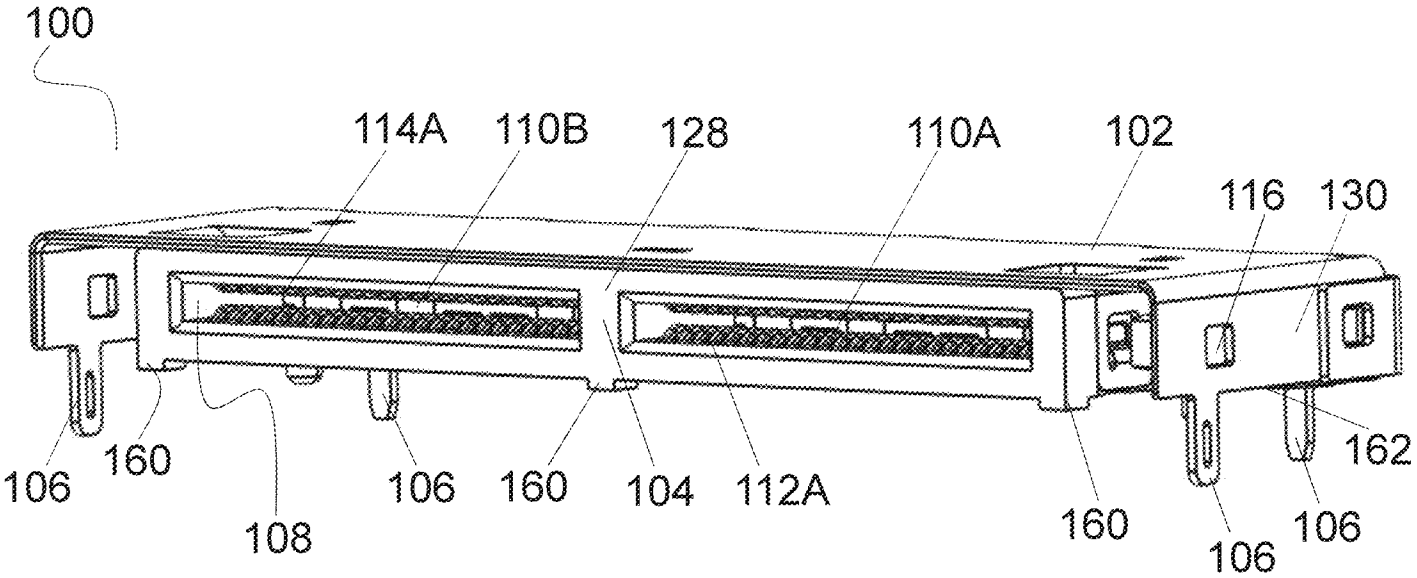
FIG. 1 is a front, right perspective view of an exemplary embodiment of a receptacle connector having airflow holes.

The following labels are used to identify principal components illustrated in the drawings:

100— receptacle connector;
102— shell;
104— housing;
106— post;
108— mating interface;
110A— first terminal module;
110B— second terminal module;
112A— mating portion;
112B— mounting portion;
114A— mating portion;
114B— mounting portion;
116— aperture;
118— projections;
120— holes;

122— opening;
124— cover;
126— rear face;
128— front face;
130— side face;
132— top face;
134— tab;
135— portion;
136— slot;
138— engagement blocks;
140— upper module;
142— lower module;
144— rear spacer;
146— front spacer;
148— gap;
150— substrate;
152— first bent portion;
154— second bent portion;
158— folding portion;
160— standoffs;
162— lower side edge;
164— lower rear edge;
166— bottom face;
168A— first row;
168B— second row;
170— cutout;
200— plug connector;
202— plug body;
204— deformable members;
210A— first paddle card;
210B— second paddle card;
212A— first slot;
212B— second slot;
216— plug projection;
218— recess;
238— engagement arm;
240— mating direction;
242— deformable portion;
244— fixed portion;
246— belt;
248— side tab;
250— connector assembly;
252— loop;
254— mounting points;
256— limiting point;
258— belt slot;
80— electronic device;
81— I/O connector;
82— printed circuit board;
83— electronic component;
84— connector assembly;
85— cable;
86— processor;
87— heat sink.

DETAILED DESCRIPTION

The inventors have recognized and appreciated designs for electrical connectors, suitable for systems with midboard cable connections, that enable secure latching that is resistant to unlatching in use. A receptacle connector may be at least partially surrounded by a shell, which may be metal and attached to a printed circuit board, providing mechanical integrity to the sidewalls of the shell. Side faces of the shell may be spaced from a housing of the receptacle connector, leaving a cavity on each side of the receptacle into which arms of a plug connector may be inserted. A lock portion on the arms of the plug may engage apertures in the side faces of the shell. As the lock portion is inside the cavity, the side faces block unintentional pressure on the lock portion, that otherwise might release the latching of the plug to the receptacle.

In some embodiments, the connector designs reduce the risk of damage to connectors during surface mount soldering operations. These designs may enable the manufacture of a compact electronic system that processes high speed signals, which benefit from miniaturized electrical connectors of low height, such as 5 mm or less, relative to a surface of a printed circuit board to which the connector system is mounted. The inventors have further recognized and appreciated that miniaturized electrical connectors having closely spaced terminal contacts, such as on a center-to-center pitch of 0.5 mm to 0.7 mm, have thin housings and would, with conventional designs, be susceptible to warpage or other damage as a result of high temperatures present when the terminal contacts are soldered to a printed circuit board. The high temperature air may damage or deform the housing of the electrical connector.

Miniaturized electrical connectors designed as described herein may be less susceptible to damage by high temperature air during surface mount soldering. In some embodiments, a receptacle connector comprises one or more airflow holes in a shell around the connector which are shaped and/or positioned so as to enable heat to flow away from the receptacle connector, thus allowing heat to dissipate as opposed to causing damage to the connector.

A high reliability SMT receptacle connector is described herein. In some embodiments, the receptacle connector comprises a housing comprising a mating interface for receiving a complementary connector, a plurality of contacts disposed in the housing, and a shell at least partially covering the housing. The shell may comprise a rear face, a top face, first and second side faces disposed opposite from each other, a first bent portion disposed between the rear face and the top face and coupling the rear face to the top face, second bent portions disposed between the first and second side faces and the top face and coupling the first and second side faces to the top face, and at least one hole disposed in the first bent portion configured to allow air to flow through.

The inventors have appreciated that airflow holes in bent portions of the shell as described herein provide for improved ventilation of heat that might otherwise be trapped within the shell and deform or damage the receptacle. When terminal contacts of the receptacle connector are soldered to a substrate, such as a printed circuit board, heat needed inside the shell for soldering contacts of the receptacle connector to the substrate will flow out through the holes and dissipate, preventing damage or deformation of the receptacle connector housing.

The inventors have further appreciated that the configuration of the holes as described herein enable easier and cheaper manufacture of the receptacle connector. For example, assembling the shell requires folding portions of a sheet of metal to be bent to form the corner between the top and rear faces. A hole may be punched through that sheet of metal where it will be bent into the corner portion of the shell as part of the bending operation. In this way, the sheet may be more easily bent and an additional machining station is not required to form the holes.

According to some embodiments, the housing of the receptacle connector has standoffs, and the lower edges of the shell are aligned with the bottom of the connector housing to leave a gap formed between the receptacle connector and a substrate, such as a printed circuit board, when the receptacle connector is mounted to the substrate. In some embodiments, the standoffs extend from the bottom face of the housing between 0.2 mm and 0.4 mm so as to create a gap having a height between 0.2 mm and 0.4 mm. In some embodiments, the gap extends from the rear face to a front face of the receptacle connector. In some embodiments, the gap extends between opposing side faces of the receptacle connector. The gap enables high temperature air used to solder the terminal contacts to the substrate to heat the solder during a reflow operation but then flow out and away from the receptacle connector, thereby preventing damage to or deformation of the receptacle connector.

In some embodiments, the rear face of the shell comprises a cutout exposing at least a portion of the plurality of contacts. In some embodiments, a first distance, in a direction perpendicular to the bottom face of the housing, between the top face and a lower edge of the rear face of the shell is less than a second distance, in the direction perpendicular to the bottom face of the housing, between the top face and a lower edge of the first or second side faces of the shell. In the embodiments described herein, contact tails of at least a portion of the plurality of contacts can be disposed in a row adjacent to the lower edge of the rear face of the shell such that the contact tails are exposed from the receptacle shell.

Designs as disclosed herein may also facilitate inspection and/or rework of solder joints between the connectors and a PCB in the event that the terminal contacts are not soldered accurately. The airflow gap, alone or in combination with a cutout in one or more faces of the shell, enables better access to the terminal contacts for reworking of the terminal contacts. Thus, designs as described herein may enable an electronic assembly of higher quality.

Connectors according to the embodiments described herein may have a height less than other components that might otherwise be on a printed circuit board in the system. For example, in some embodiments, the shell has a height less than 5 mm. In some embodiments, the shell has a height less than 4 mm.

In some embodiments, the receptacle connector comprises latching elements to configure a secure connection of a complementary connector to the receptacle connector. In some embodiments, the receptacle connector comprises a pair of projections configured to engage with a pair of recesses of the complementary connector. The pair of projections may allow for easier guiding of the complementary connector in a proper alignment when mating with the receptacle connector. In some embodiments, the shell of the receptacle connector comprises an aperture configured to receive a projection of the complementary connector. The aperture may allow for easy insertion of the complementary connector, while preventing the complementary connector from being removed from the receptacle connector inadvertently. Inadvertent removal of the complementary connector from the receptacle connector may result in an undesired break in electrical communication between the connectors.

Secure latching may promote reliable operation of the system by avoiding problems that might otherwise occur were the mated connectors free to move relative to each other over a range of motion allowed by conventional latching systems. Such problems could include intermittent disconnection of the mating contacts within the connectors, separation of the connectors sufficient to break connections between the mating contacts, changes in impedance of the signal paths, and fretting of mating contacts of the connectors and eventual failure of the interconnects that might result were the connectors able to move relative to each other while mated.

Further, the unlatching structures described herein occupy little space, and the structures are compact, making it easier to realize product functions.

Figure 2:
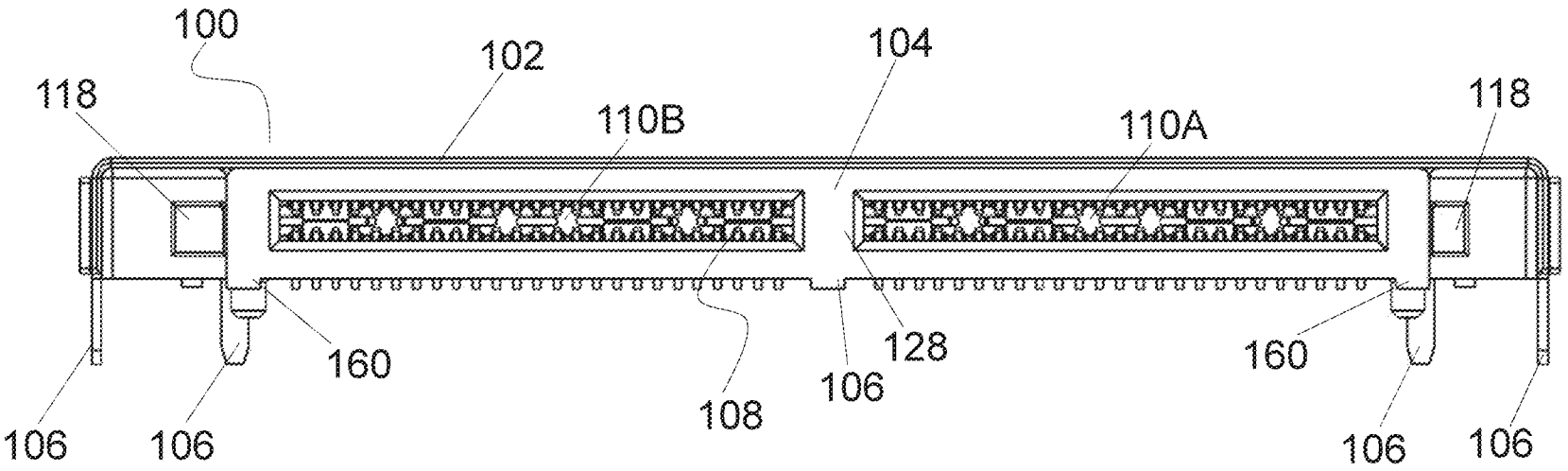
FIG. 2 is a front view of the receptacle connector having airflow holes.

Representative embodiments are explained further below with reference to the accompanying drawings. FIG. 1 is a front, right perspective view of an exemplary embodiment of a receptacle connector 100 having airflow holes. As shown in FIG. 1, receptacle connector 100 comprises a shell 102, a housing 104, and a plurality of contacts 112, 114 disposed in the housing 104. In some embodiments, the receptacle connector 100 is configured for mounting to a substrate, such as a printed circuit board 150, using surface mount soldering techniques. Posts 106, which are in this example formed as a portion of shell 102, may extend into openings of printed circuit board 150. In some embodiments, the receptacle connector 100 is configured for mating with a complementary connector, such as plug connector 200, at a mating interface 108. FIG. 2 is a front view of the receptacle connector 100 having airflow holes, as described herein.

Shell 102 may be formed of any suitable material. For example, shell 102 may be formed of metal to provide shielding for the receptacle connector 100. Shell 102 may at least partially cover the housing 104. Shell further comprises posts 106 extending from the shell 102. Posts 106 may extend into openings in printed circuit board 150, to which receptacle connector 100 is mounted to position receptacle connector 100 with respect to pads on the surface of printed circuit board 150 before soldering and to increase ruggedness of the assembly after soldering. Posts 106 may be soldered into the holes in the printed circuit board 150 or may be shaped to provide retention force upon insertion into the holes using an interference fit or a press-fit.

Shell 102 comprises a top face 132, a rear face 126, and opposing side faces 130. Rear face 126 may be substantially parallel to a front face 128 of the receptacle connector 100, and substantially perpendicular to top face 132 and side faces 130. Opposing side faces 130 may be disposed opposite and substantially parallel to each other, and substantially perpendicular to top face 132, rear face 126, and front face 128. Shell 102 may be formed by stamping and bending operations on a sheet of metal. Accordingly, a first bent portion 152 may be disposed between top face 132 and rear face 126, coupling top face 132 to rear face 126. Second bent portions 154 may be formed between top face 132 and side faces 130, coupling top face 132 to side faces 130, respectively.

Shell 102 may have a relatively low height. For example, in some embodiments, the shell 102 has a height less than 5 mm. In some embodiments, the shell 102 has a height less than 4 mm.

In some embodiments, side faces 130 of shell 102 are provided with features that facilitate latching with a complementary connector, such as plug connector 200. As shown in FIG. 1, for example, side faces 130 of shell 102 may comprise apertures 116 configured to engage with a projection 216 of a complementary connector, such as plug connector 200. The apertures 116 may allow for easy insertion of the complementary connector, while preventing the complementary connector from being removed from the receptacle connector 100 inadvertently as will be described herein with reference to connector assembly 250.

Figure 3:
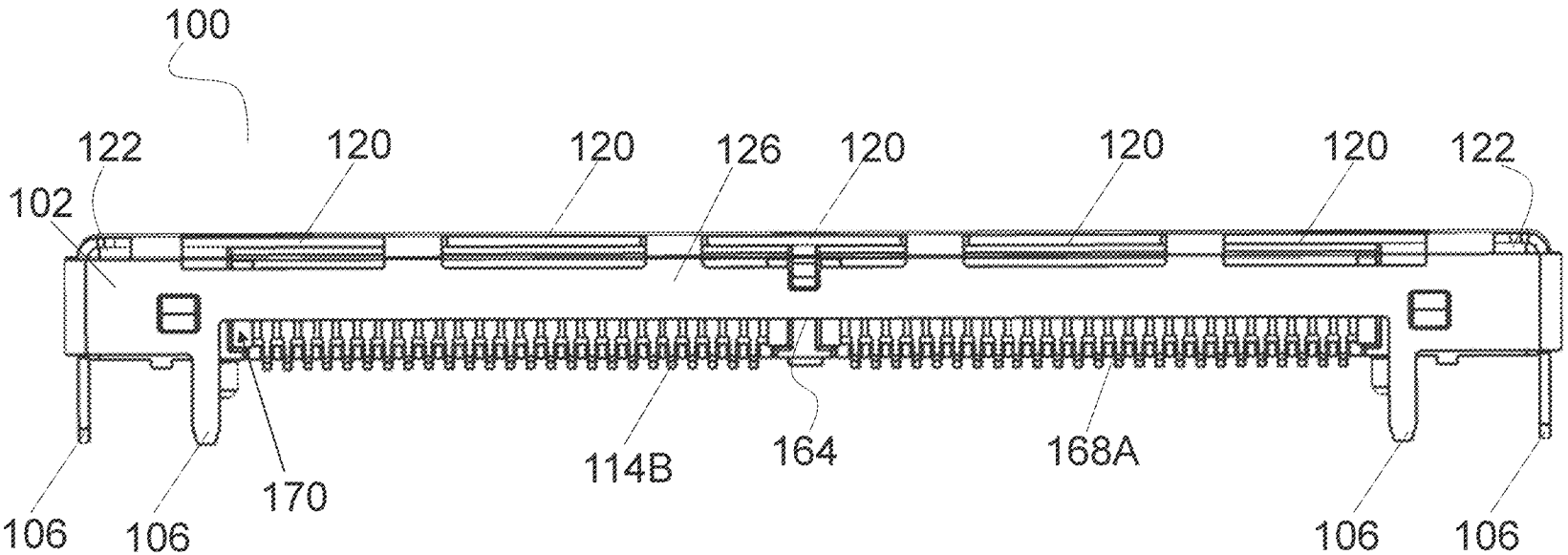
FIG. 3 is a rear view of the receptacle connector having airflow holes.

FIG. 3 is a rear view of the receptacle connector 100 having airflow holes. As shown in FIG. 3, the shell may comprise a plurality of holes 120 disposed in first bent portion 152 to provide ventilation for the receptacle connector 100, as described herein. The inventors have appreciated that the receptacle connector 100 may be configured having any suitable number of holes 100 and embodiments of the technology are not limited in this respect. For example, the plurality of holes 120 may comprise at least one hole or more than one hole. In the embodiment illustrated in FIG. 3, the plurality of holes 120 comprises five airflow holes. The airflow holes collectively occupy a substantial portion of the corner between top face 132 and rear face 126. For example, the plurality of holes may extend over at least 80% of a width of the shell.

Figure 6:
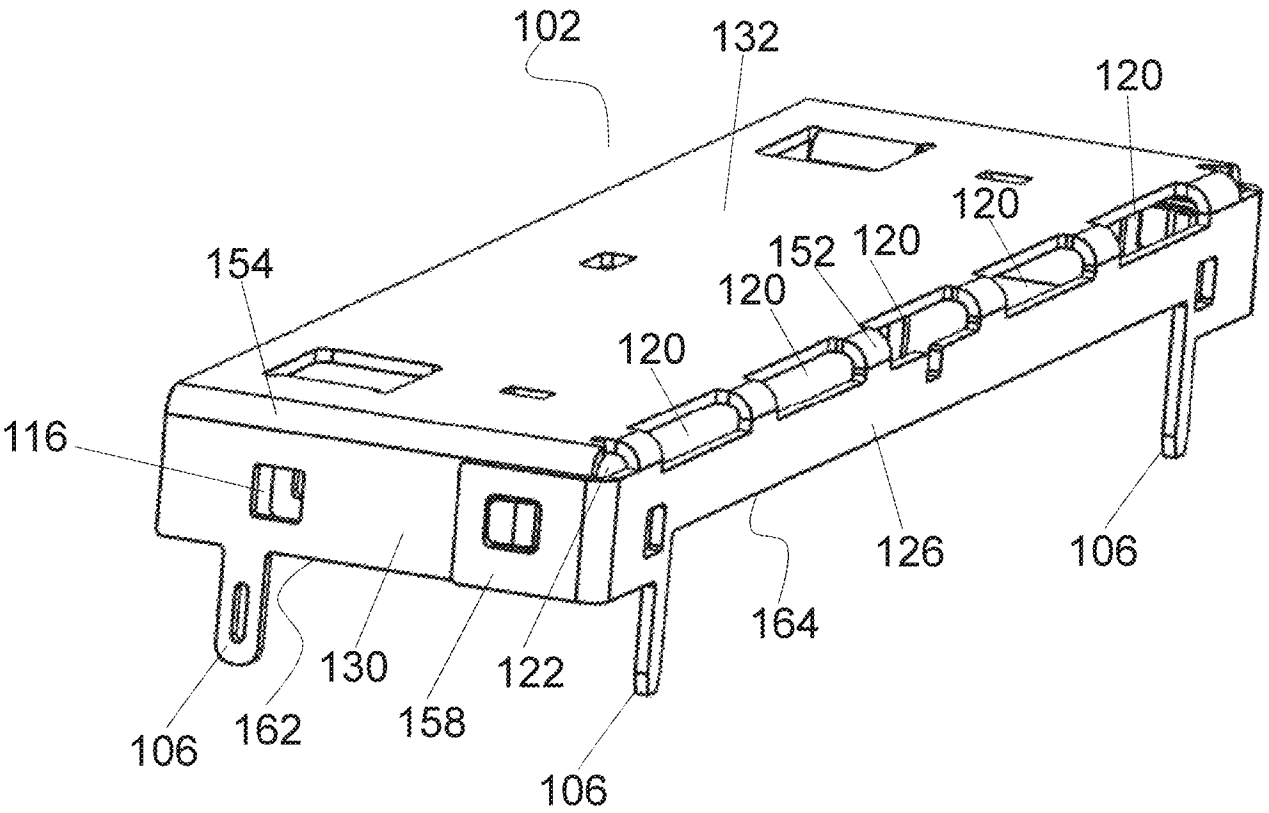
FIG. 6 is a rear, right perspective view of a shell of the receptacle connector of FIG. 1.

In the embodiment illustrated in FIG. 6, the plurality of holes 120 are shown as generally rectangular, but other holes with other shapes may be used, such as elliptical.

As described herein, the plurality of holes 120 are configured to provide for ventilation of high temperature air generated when terminal contacts 112, 114 are soldered to a printed circuit board 150. The plurality of holes 120 may be shaped and/or positioned so as to enable heat to flow away from the receptacle connector 100, thus allowing heat to dissipate as opposed to causing damage to the receptacle connector 100. The inventors have appreciated that placement of the plurality of holes 120 in the first bent portion 152 of the shell 102 according to embodiments of the technology described herein provides for improved ventilation of heat through the plurality of holes 120 that might otherwise be trapped within the shell 102 and deform or damage the receptacle connector 100 during a surface mount soldering operation.

The inventors have further appreciated that the configuration of the plurality of holes 120 as described herein enables easier and cheaper manufacture of the receptacle connector 100. For example, assembly the shell 102 requires folding a sheet of metal to form a top face 132, a rear face 126, and a first bent portion 152 therebetween. One or more of the plurality of holes 120 may be punched through the sheet of metal where it is to be bent into the first bent portion 152 of the shell 102 as part of the bending operation. Therefore, the sheet of metal comprising the shell 102 may be more easily bent and additional machining is not required form the plurality of holes 120.

As shown in FIG. 3, the rear face 126 of the shell 102 comprises a cutout 170 exposing at least a portion of the plurality of contacts 112, 114. In other words, a first distance, in a direction perpendicular to a bottom face 166 of the housing 104, between the top face 132 and a lower edge 164 of the rear face 126 of the shell 102 is less than a second distance, in the direction perpendicular to the bottom face 166 of the housing 104, between the top face 132 and a lower edge 162 of the first or second side faces 130 of the shell 102. The inventors have appreciated that a third distance, equal to the difference between the first and second distances, may be sized such that at least a portion of the plurality of contacts 112, 114 are exposed at the rear face 126. In some embodiments, the difference between the first and second distances is between 0.5 mm and 1.5 mm.

In the illustrated embodiment, a first row 168A of contacts is illustrated as exposed by the cutout 170. In particular, mounting portions 114B of the plurality of signal contacts 114 are illustrated as exposed by the cutout 170. Cutout 170 facilitates inspection and/or rework of solder joints between the connector 100 and a printed circuit board 150 in the event that the plurality of contacts 112, 114 are not soldered accurately.

Figure 4:
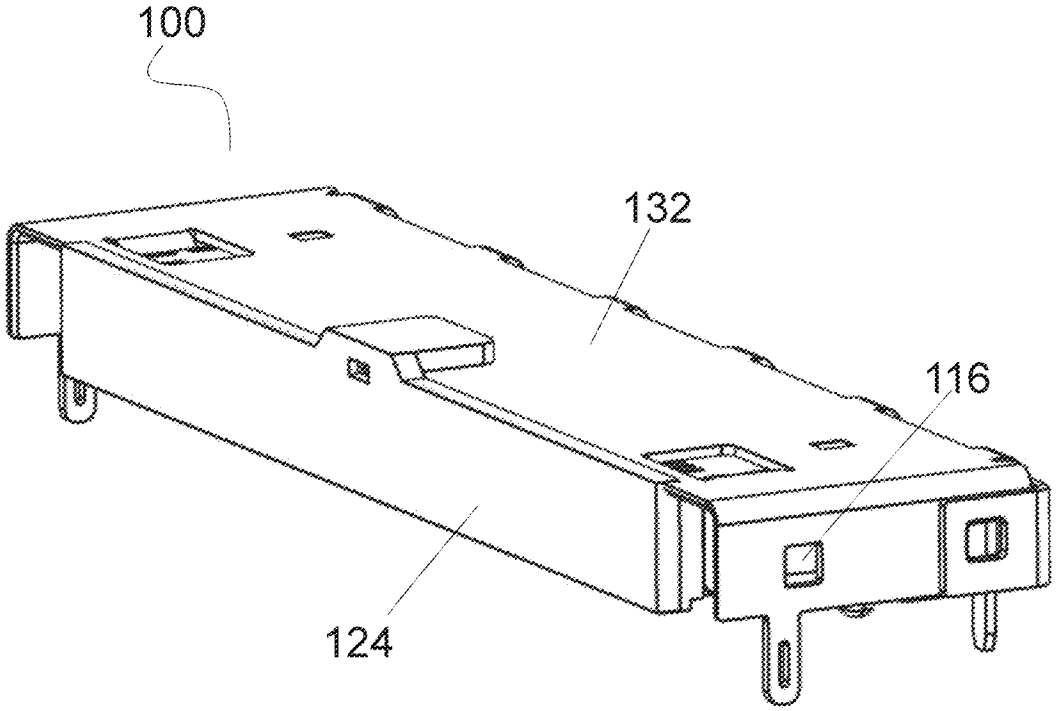
FIG. 4 is a front, right perspective view of the receptacle connector having airflow holes further comprising a cover on a mating interface.

The receptacle connector 100 may have a cover 124 to cover the mating interface 108, as shown in FIG. 4. FIG. 4 is a front, right perspective view of the receptacle connector 100 having airflow holes further comprising a cover 124 on the mating interface 108. The cover 124 covers the mating interface 108 of the receptacle connector 100 and may prevent unwanted material from entering mating interface 108. Cover 124, for example, may be installed before connector 100 is soldered to printed circuit board 150 to prevent heated air from entering mating interface 108 during a surface mount soldering operation, which might deform or otherwise damage the receptacle connector. However, as can be seen in FIG. 4, cover 124 does not extend below the lower edges of the shell 102 so as not to block gap 148 that facilitates flow of heated air over ground mounting portions 112B and signal mounting portions 114B so that they may be soldered to a substrate. Cover 124 is removable and may be removed without tools before use of receptacle connector 100.

Figure 5A:
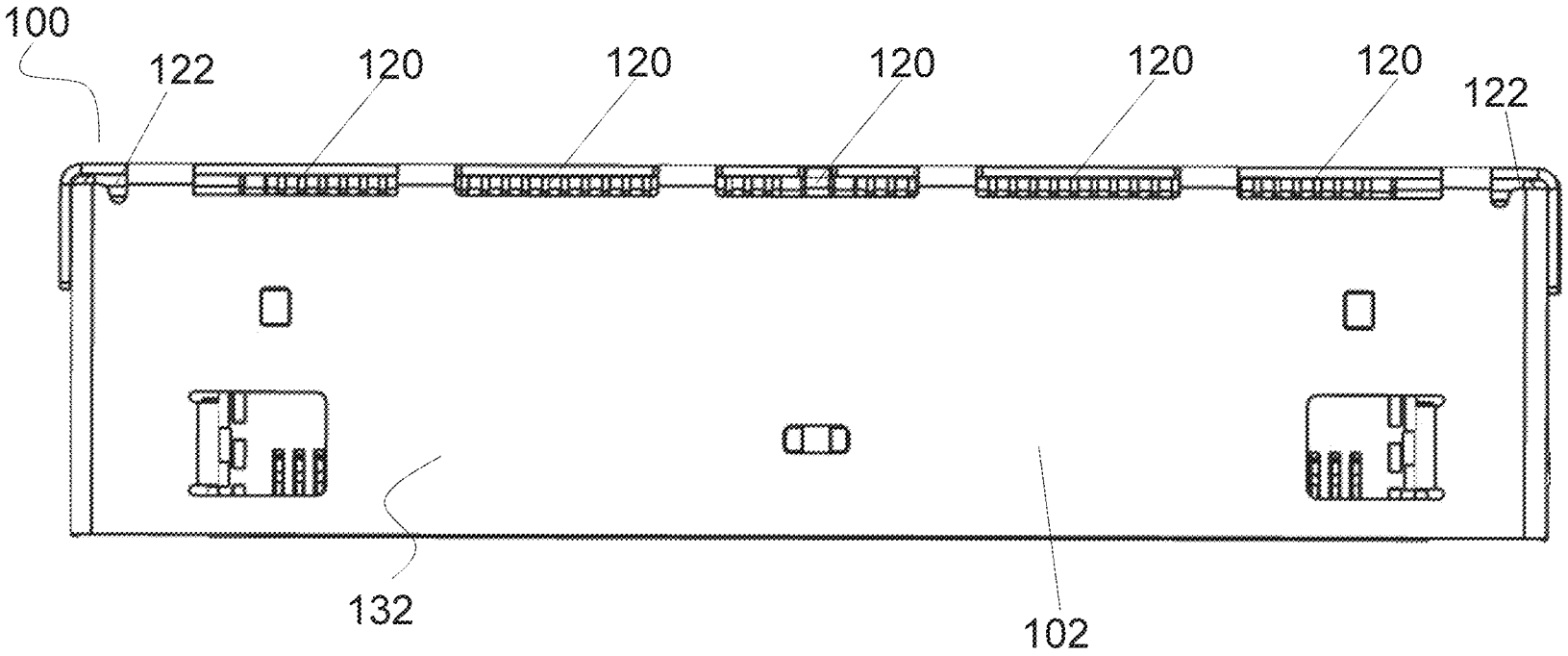
FIG. 5A is a top view of the receptacle connector having airflow holes.
Figure 5B:
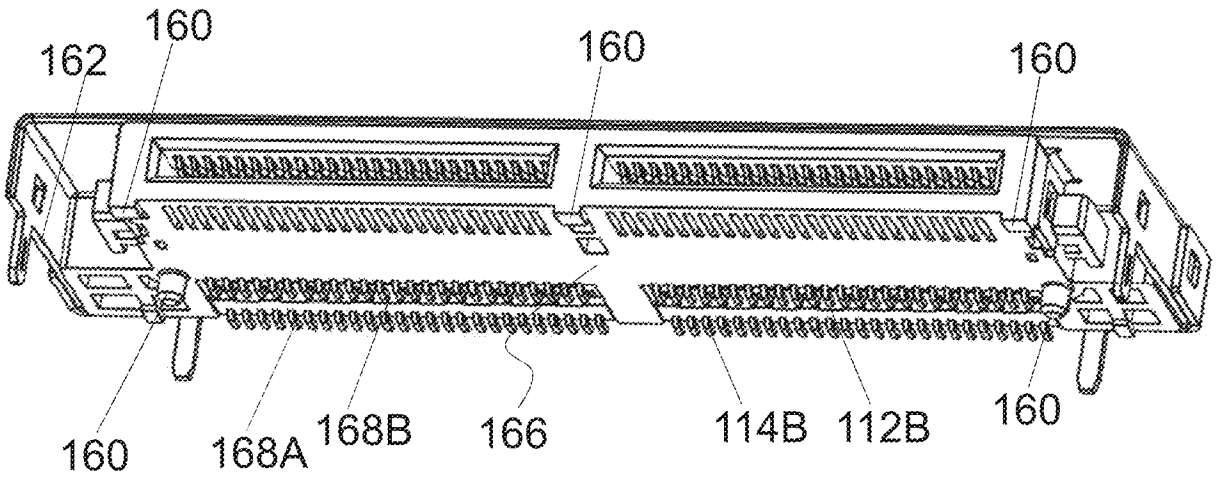
FIG. 5B is a front, bottom perspective view of the receptacle connector having airflow holes.

FIGS. 5A-B are top and front, bottom perspective views of the receptacle connector 100 having airflow holes. As shown in FIG. 5B and described herein, the housing 104 comprises one or more standoffs 160 configured to leave a gap 148 formed between the receptacle connector 100 and printed circuit board 150, when the receptacle connector 100 is mounted to the printed circuit board.

As shown in FIG. 5B, the housing 104 further comprises a bottom face 166. Each of the side faces 130 of shell 102 comprises a lower edge 162. In some embodiments, the lower edges 162 are configured to be aligned with the bottom face 166 of the housing 104. The one or more standoffs 160 may be configured to extend from the bottom face 166 of the housing 104 beyond the lower edges 162 of the first and/or second side faces 130. When the receptacle connector 100 is mounted to printed circuit board 150, the one or more standoffs 160 extending from the bottom face 166 and beyond the lower edges 162 which are in alignment with the bottom face 166 allows gap 148 to be formed. In the embodiments as described herein, the shell 102 is configured so as to not block the gap 148. The gap 148 enables heated air to preferentially heat the mounting interface during a surface mount soldering operation such that mounting portions 112B, 114B may be soldered to printed circuit board 150, while limiting the heating of other portions of receptacle connector 100.

As shown in FIG. 5B, mounting portions 112B, 114B of the plurality of contacts may extend beyond the bottom face 166 of the housing 104. Mounting portions 114B may be arranged in a first row 168A and mounting portions 112B may be arranged in a second row 168B.

FIG. 6 is a rear, right perspective view of the shell 102 of receptacle connector 100. As shown in FIG. 6, rear face 126 may comprise folding portions 158 at opposing ends of the rear face 126. Folding portions 158 may be folded onto side faces 130 at a substantially right angle, thereby connecting rear face 126 to side faces 130.

In some embodiments, openings 122 in shell 102 are disposed between the first bent portion 152 and second bent portions 154. Openings 122 may be formed when folding portions 158 of the rear face 126 are folded onto side faces 130. Therefore, no additional machining is required to form openings 122. Openings 122, like holes 120, may allow air to flow away from receptacle connector 100. Therefore, openings 122 may serve as an additional ventilation mechanism for receptacle connector 100. However, it is not a requirement that openings 122 be configured to allow air to flow through.

Figure 7B:
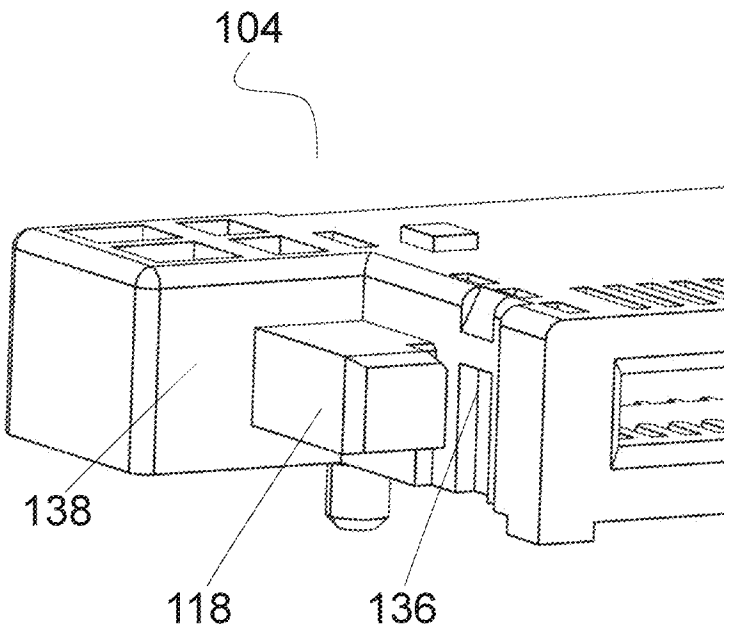
FIG. 7B is an enlarged view of a portion of a housing of the receptacle connector of FIG. 1.
Figure 7A:
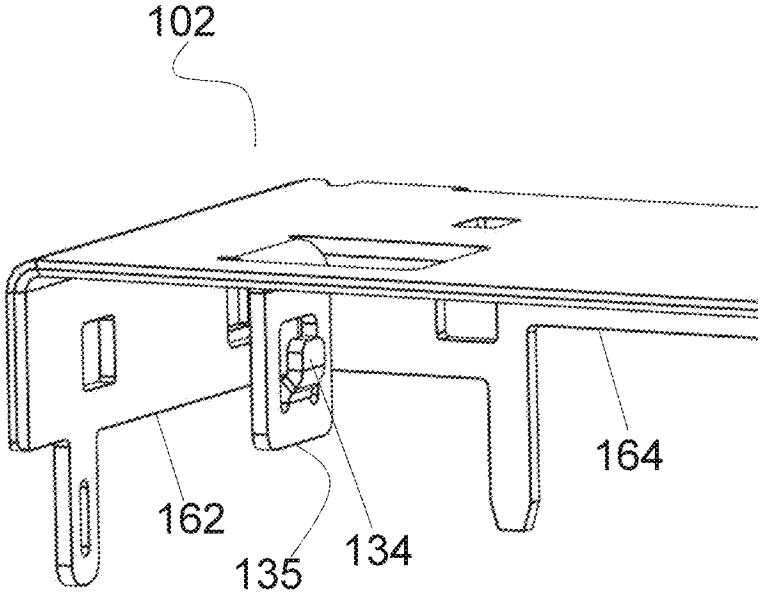
FIG. 7A is an enlarged view of a portion of the shell of the receptacle connector of FIG. 1.

FIG. 7A is an enlarged view of a portion of the shell 102 of the receptacle connector 100. As shown in FIG. 7A, shell 102 may comprise engagement features to ensure a secure connection between housing 104 and shell 102. FIG. 7*a* shows an end of shell 102, including such an engagement feature. FIG. 7B is an enlarged view of a portion of the housing 104 of the receptacle connector 100 including complementary engagement features configured to ensure a secure connection of the housing 104 to the shell 102. FIGS. 7A and 7B illustrate one end of the shell and connector housing. The other ends of the shell and housing may have similar engagement features.

As an example of engagement features, shell 102 may comprise a tab 134 formed in portion 135, which in this example has been cut from the upper surface of the shell 102 and bent perpendicular to it. Housing 104 may have a slot 136 next to projection 118. To secure shell 102 to housing 104, shell 102 may be pressed downwards such that portion 135 fits between projection 118 and the rest of housing 104. Tab 134 may be pressed into portion 135 until it is aligned with slot 136 such that tab 134 extends into slot 136. Motion of shell 102 away from housing 104 will thereafter be blocked because tab 134 will abut an end of the slot 136.

Figure 8:
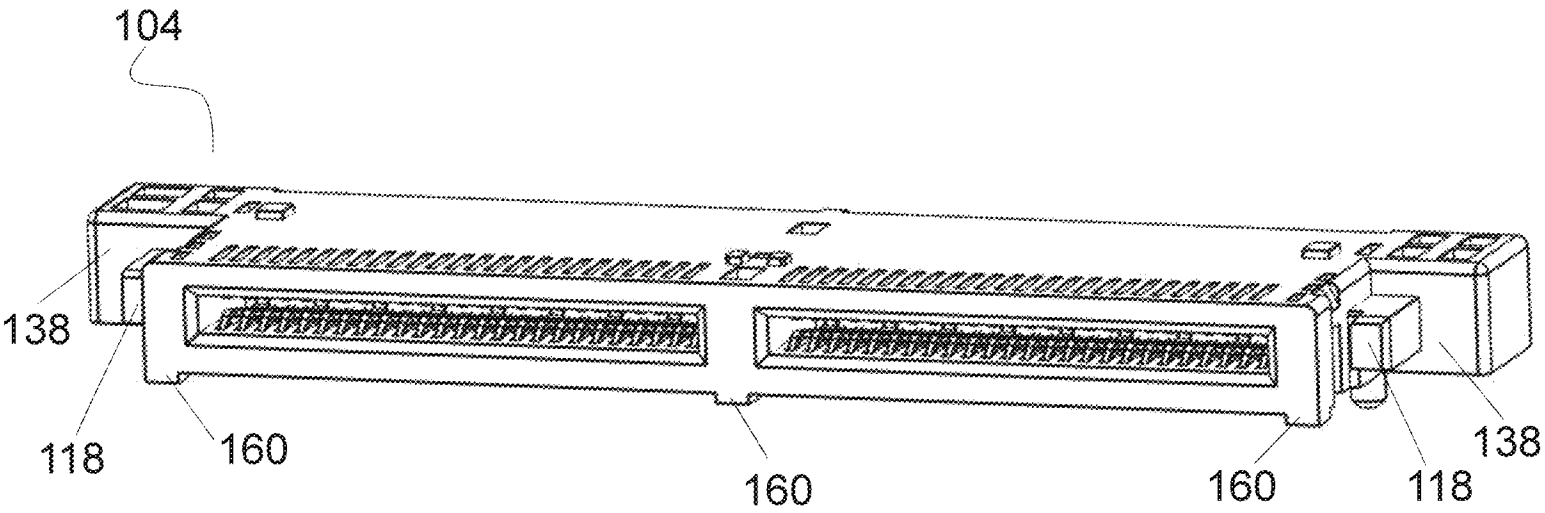
FIG. 8 is a front, right perspective view of the housing of the receptacle connector of FIG. 1.

FIG. 8 is a front, right perspective view of the housing 104 of receptacle connector 100. Housing 104 may be formed of an insulative material, such as plastic, which may be molded to provide the shape illustrated. Housing 104 may be shaped to form a mating interface 108 configured to receive a complementary connector, such as plug connector 200. First and second terminal modules 110A-B may be disposed in the housing 104 such that contact portions of terminals are exposed at the mating interface 108 to allow for mating to a complementary connector.

As shown in FIG. 8, housing 104 may comprise one or more standoffs 160 configured to leave a gap 148 formed between the receptacle connector 100 and a printed circuit board 150, when the receptacle connector 100 is mounted to the printed circuit board 150. The one or more standoffs 160 may be formed as a portion of the housing 104, such as via a molding operation. In some embodiments, the one or more standoffs 160 may be separately formed and then attached to the housing 104, but in the embodiment illustrated, the one or more standoffs 160 are integrally formed with the rest of the housing 104.

The one or more standoffs 160 may be manufactured having dimensions that result in a gap 148 to enable suitable airflow for surface mount soldering while providing a compact electronic assembly. In some embodiments, the one or more standoffs 160 extend from the bottom face 166 of the housing 104 between 0.2 mm and 0.4 mm so as to create a gap 148 having a height between 0.2 mm and 0.4 mm. The inventors have appreciated that manufacturing the receptacle connector 100 such that the one or more standoffs 160 extend from the bottom face 166 of the housing 104 between 0.2 mm and 0.4 mm facilitates a receptacle connector 100 having a low profile while still enabling the creation of a gap 148 large enough to allow air to flow through, as described herein.

In some embodiments, left and right sides of housing 104 are provided with features that facilitate latching to a complementary connector, such as plug connector 200. As shown in FIG. 8, engagement blocks 138 are provided on sides of housing 104. Engagement blocks 138 may be formed as a portion of housing 104, such as via a molding operation. Engagement blocks 138 may be separately formed and then attached to the housing 104, but in the embodiment illustrated, the engagement blocks 138 are integrally formed with the rest of the housing 104. In the illustrated embodiment, the engagement blocks 138 are spaced to align with engagement arms 238 (FIG. 15) of a complementary connector, such as plug connector 200.

The engagement blocks 138 are provided with a projection 118 at an end close to the mating interface 108. Projections 118 are configured to engage with a recess 218 of a complementary connector, such as plug connector 200. In this way, projections 118 allow for easier guiding of the complementary connector in a proper alignment when mating with the receptacle connector 100, and are an example of a guide portion.

Figure 9:
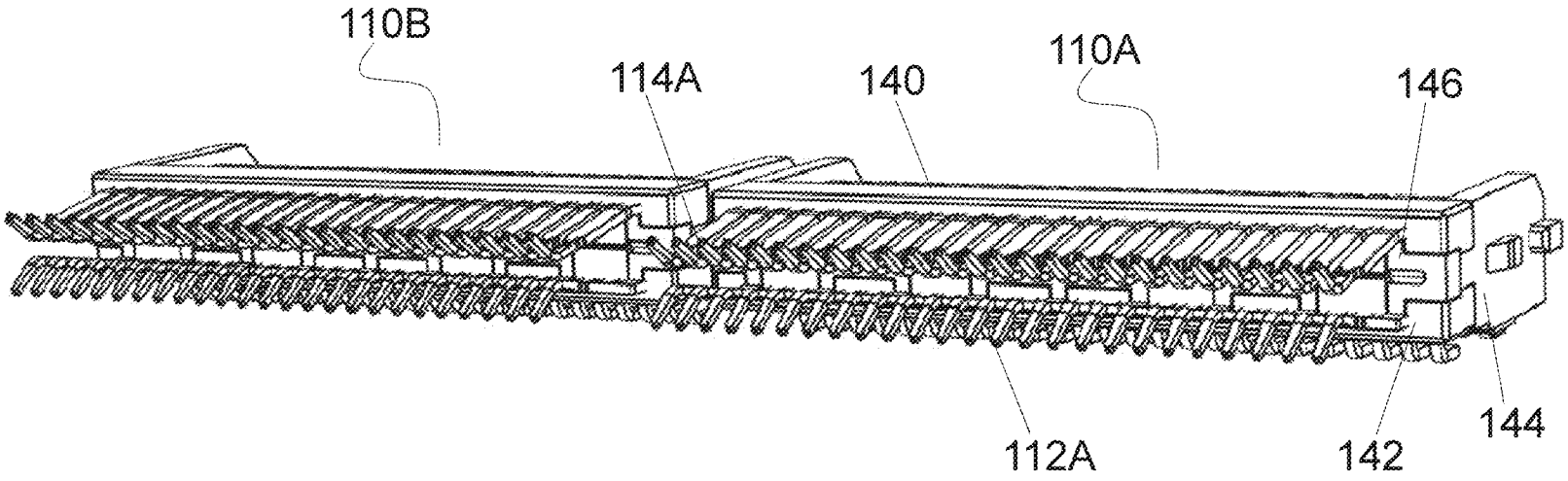
FIG. 9 is a front, right perspective view of a terminal assembly of the receptacle connector of FIG. 1.

FIG. 9 is a front right perspective view of a terminal assembly of the receptacle connector 100. The terminal assembly as shown in FIG. 9 may comprise first and second terminal modules 110A-B. Although two terminal modules 110 are shown in the illustrated embodiment, receptacle connector 100 may comprise any suitable number of terminal modules 110.

First and second terminal modules 110A-B comprise a plurality of contacts. In the illustrated embodiment, the contacts are arrayed in two rows, with upper row contacts 114 and lower row contacts 112. Upper row contacts 114 comprise a mating portion 114A to mate with contacts of a complementary connector, such as pads on an upper surface of a paddle card of a plug connector 200, and a mounting portion 114B to be mounted to printed circuit board. Likewise, lower row contacts 112 comprise a mating portion 112A to mate with contacts of a complementary connector, such as pads on a lower surface of a paddle card of a plug connector 200, and a mounting portion 112B, to be mounted to a printed circuit board.

In the illustrated embodiment, the contacts in each of the upper row and the lower row are of the same size and shape, each contact may be used as a signal or a ground contact. In other embodiments, the contacts may have different shapes or may be spaced differently with respect to adjacent contact. For example, ground contacts may be wider than signal contact so the edge to edge spacing between a pair of signal contacts may be less than the spacing between each of those signal contacts and another adjacent contact.

Figure 10:
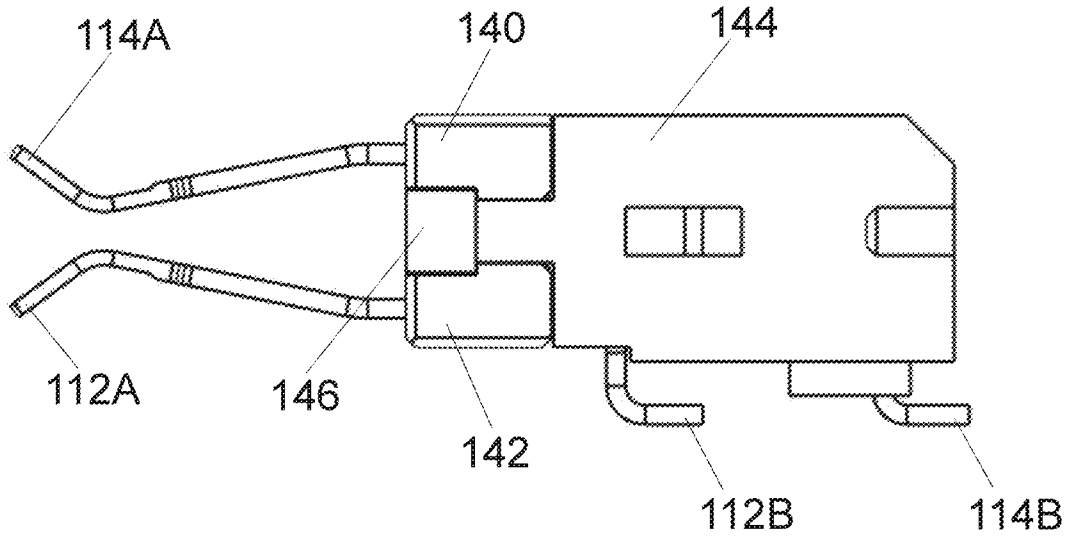
FIG. 10 is a side view of the terminal assembly of FIG. 9.

FIG. 10 is a side view of the terminal assembly shown in FIG. 9. As shown in FIG. 10, mating portions 112A, 114A of lower row contacts 112 and upper row contacts 114 are configured to extend outwards into the mating interface 108. Mounting portions 112B, 114B extend in a rearwards direction away from mating portions 112A, 114A and are bent at a substantially right angle such that they can be mounted to printed circuit board 150 substantially perpendicular to the mating interface 108. As described herein, mounting portions 112B, 114B may be arranged in first and second rows 168A-B.

As shown in FIGS. 9-10, terminal modules 110A-B comprise an upper module 140, a lower module 142, a front spacer 146, and a rear spacer 144. Upper module 140 is configured to hold the plurality of upper row contacts 114, while lower module 142 is configured to hold the plurality of lower row contacts 112. Front spacer 146 is disposed between upper module 140 and lower module 142. Front spacer 146 is configured to space the mating contact portions 114A of the plurality of upper row contacts 114 from the mating contact portions 112A of the plurality of lower row contacts 112. Rear spacer 144 is disposed behind upper module 140, front spacer 146, and lower module 142 and is configured to space the mounting portions 112B, 114B from each other. Rear spacer 144 may comprise latching elements configured to couple first and second terminal modules 110A-B to the housing 104.

Figure 11:
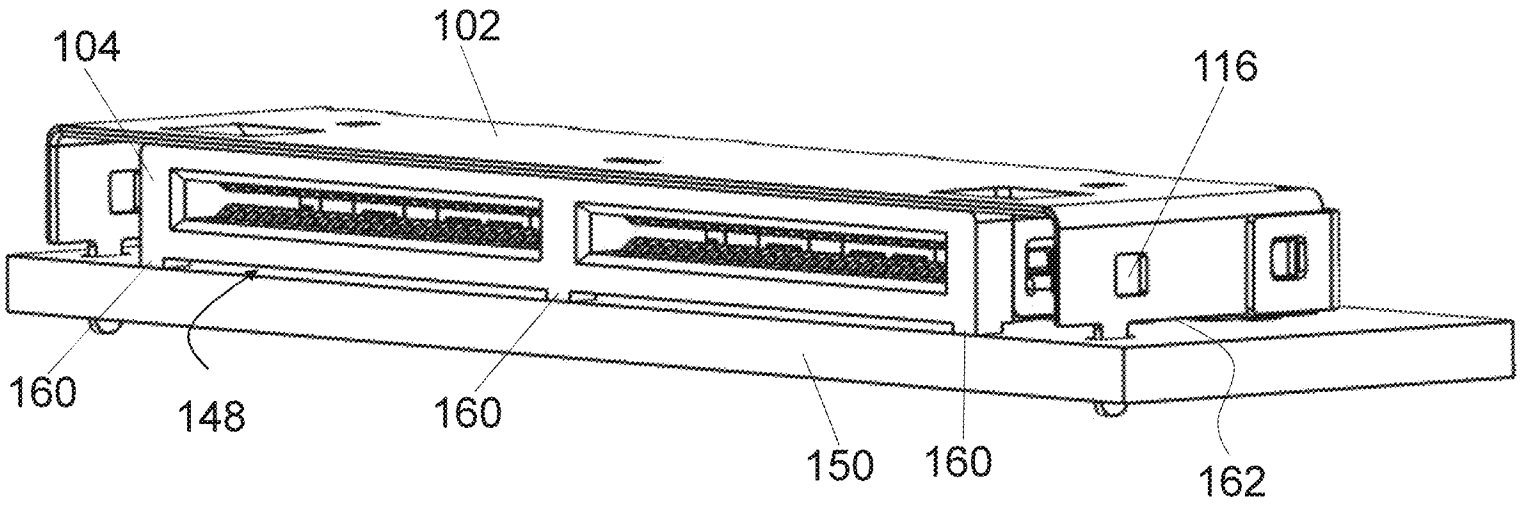
FIG. 11 is a front, right perspective view of the receptacle connector of FIG. 1 mounted to a substrate.
Figure 12:
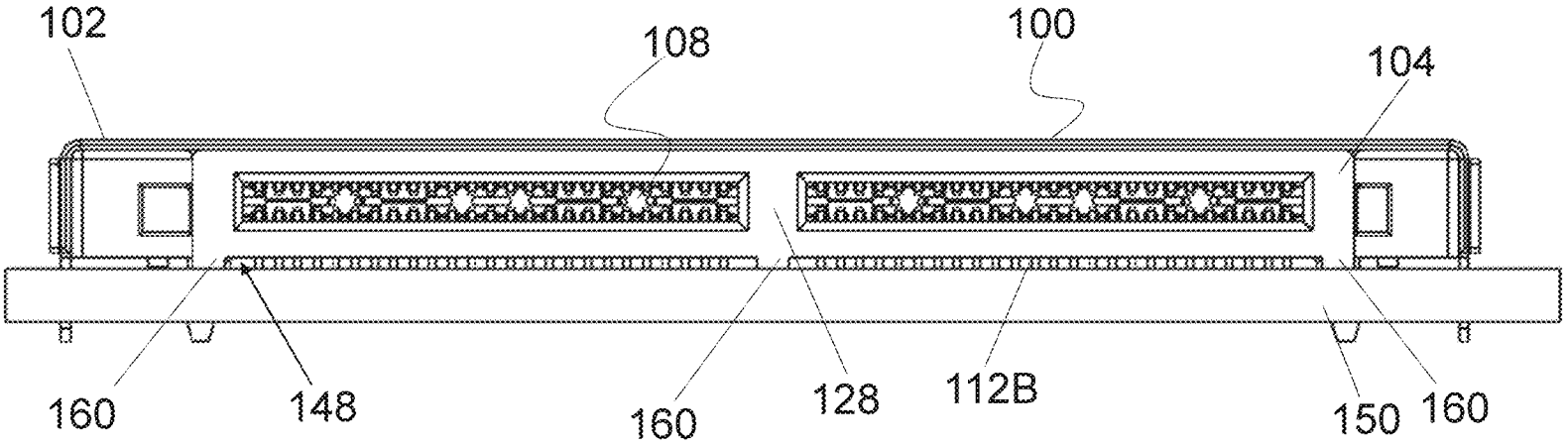
FIG. 12 is a front view of the receptacle connector of FIG. 1 mounted to the substrate.
Figure 13:
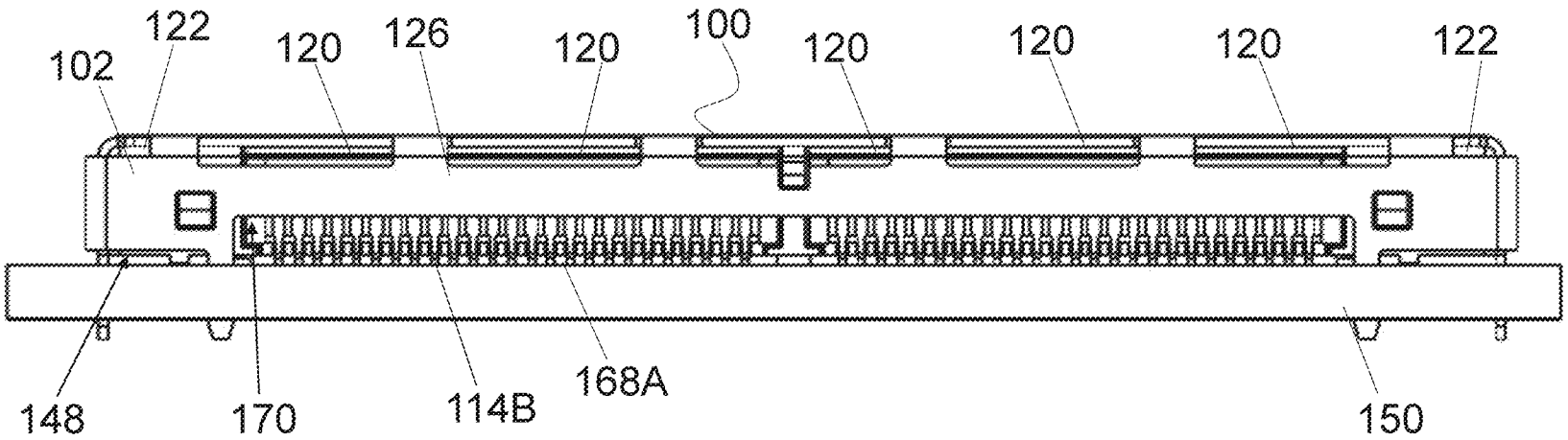
FIG. 13 is a rear view of the receptacle connector of FIG. 1 mounted to the substrate.
Figure 14B:
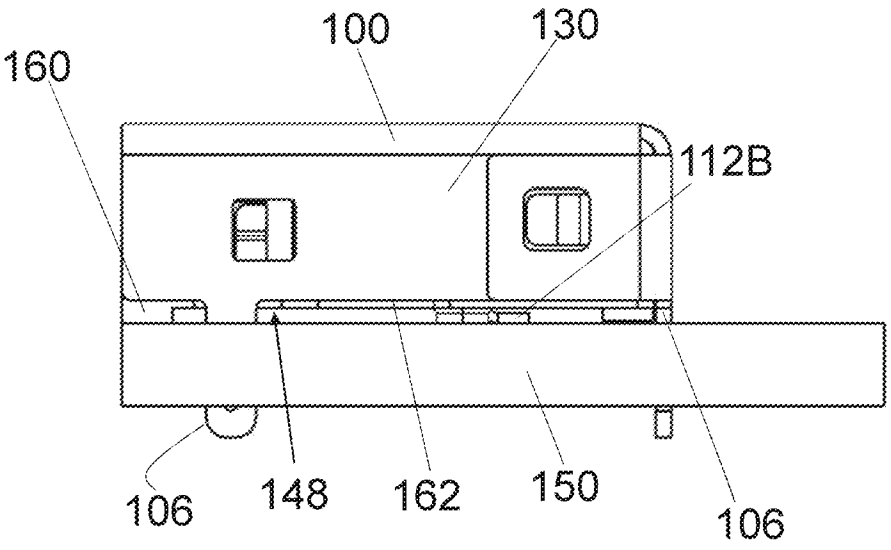
FIG. 14B is a side view of the receptacle connector of FIG. 1 mounted to a substrate.
Figure 14A:
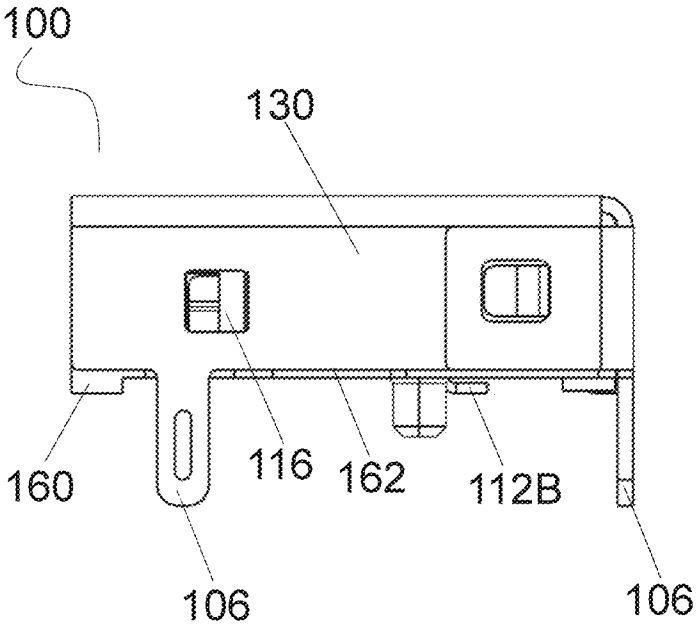
FIG. 14A is a side view of the receptacle connector of FIG. 1.

FIG. 11 illustrates a front right perspective view of receptacle connector 100, mounted to printed circuit board 150. In some embodiments, the receptacle connector 100 is surface mount soldered to printed circuit board 150. FIG. 12 is a front view of the receptacle connector 100 mounted to the printed circuit board 150. FIG. 13 is a rear view of the receptacle connector 100 mounted to the printed circuit board 150. FIG. 14A is a side view of the receptacle connector 100. FIG. 14B is a side view of the receptacle connector 100 mounted to a printed circuit board 150.

In an electronic system, printed circuit board 150, may have electronic components in addition to the receptacle connector 100 mounted to it. In some embodiments, receptacle connector 100 may be mounted in a central portion of the printed circuit board 150.

As described herein, posts 106 may facilitate alignment and/or mounting of receptacle connector 100 to printed circuit board 150. Posts 106 may be soldered to printed circuit board 150 to ensure a secure connection of receptacle connector 100 to the printed circuit board 150. In embodiments in which a latch of a plug connector engages with apertures in shell 102, securing posts 106 to printed circuit board 150, may enhance the reliability of the connection between the plug and the receptacle. In some embodiments, posts 106 may be received in holes formed in the printed circuit board 150. In some embodiments, posts 106 may extend completely through the holes in the printed circuit board 150. In other embodiments, posts 106 may only extend partially through the holes in the printed circuit board 150. Those holes may be connected to ground structures within the printed circuit board such that, attaching the posts 106 inside the holes, the shell 102 is grounded, enabling it to serve as an electromagnetic shield.

Mounting portions 112B, 114B of the plurality of lower row contacts 112 and the plurality of upper row contacts 114 may be soldered to the printed circuit board 150. High temperature air may be flowed over mounting portions 112B, 114B to solder them to the printed circuit board 150, A gap 148 may be provided to selectively direct that high temperature air to the mounting portions 112B, 114B, which may, for example, be placed in solder paste that is heated to fuse the mounting portions to pads on a surface a printed circuit board 150.

In some embodiments, when receptacle connector 100 is mounted to the printed circuit board 150, connector 100 is spaced from the printed circuit board 150 to leave a gap 148 between the receptacle connector 100 and the printed circuit board 150. In some embodiments, the gap 148 may be formed such that the only contact between the printed circuit board 150 and the receptacle connector 100 occurs at the posts 106, the mounting portions 112B, 114B, and the one or more standoffs 160. In other words, the housing 104 and the shell 102 may only contact the printed circuit board 150 at discrete locations where the posts 106 and the one or more standoffs 160 are formed.

As shown in FIGS. 11-14, the gap 148 may reduce contact between the receptacle connector 100 and the printed circuit board 150. High temperature air may therefore flow through the gap 148 during surface mount soldering. By this design, the gap 148 forms an airflow passage between the receptacle connector 100 and the printed circuit board 150 such that the high temperature air can reach locations where heat is required for soldering but is isolated from other portions of the receptacle connector 100 where heat might deform or otherwise damage the receptacle connector 100.

In some embodiments, the gap 148 extends from the front face 128 of the receptacle connector 100 to the rear face 126. In some embodiments, the gap 148 extends between the side faces 130 of the receptacle connector 100, and is bounded, on an upper side by a substantially solid bottom face 166.

Nonetheless, heat from that soldering operation may build up inside shell 102 and may deform or otherwise damage the housing 104 and/or any of the components of the terminal subassembly inside the housing. Deformation of any of the components that position the terminals may interfere with proper mating of the receptacle connector to a plug, and may impact performance of the electronic system using such a connector, such as by providing a mating force that is lower than the designed value. The risk of deformation is particularly high for a miniaturized connector as described herein. The plurality of holes 120 enable high temperature air to flow out through the holes 120 to prevent damage to the receptacle connector 100.

Positioning the holes as illustrated may desirably release heat, may be formed as part of other operations that would otherwise be performed to shape shell 102 and may provide a relatively low impact on the effectiveness of shell 102 as an electromagnetic shield.

The airflow passage formed by gap 148 may be used in instead of or in addition to the plurality of holes 120. However, in the illustrated embodiment, the airflow passage formed by gap 148 is used in conjunction with the plurality of holes 120.

As described herein, the receptacle connector 100 according to some embodiments may also facilitate inspection and/or rework of solder joints between the receptacle connector 100 and the printed circuit board 150 in the event that the plurality of contacts 112, 114 are not soldered accurately. Gap 148, alone or in combination with cutout 170 in one or more faces of the shell as described herein, enables better access to the terminal contacts for reworking of the terminal contacts. Thus, designs as described herein may enable an electronic assembly of higher quality.

Figure 15:
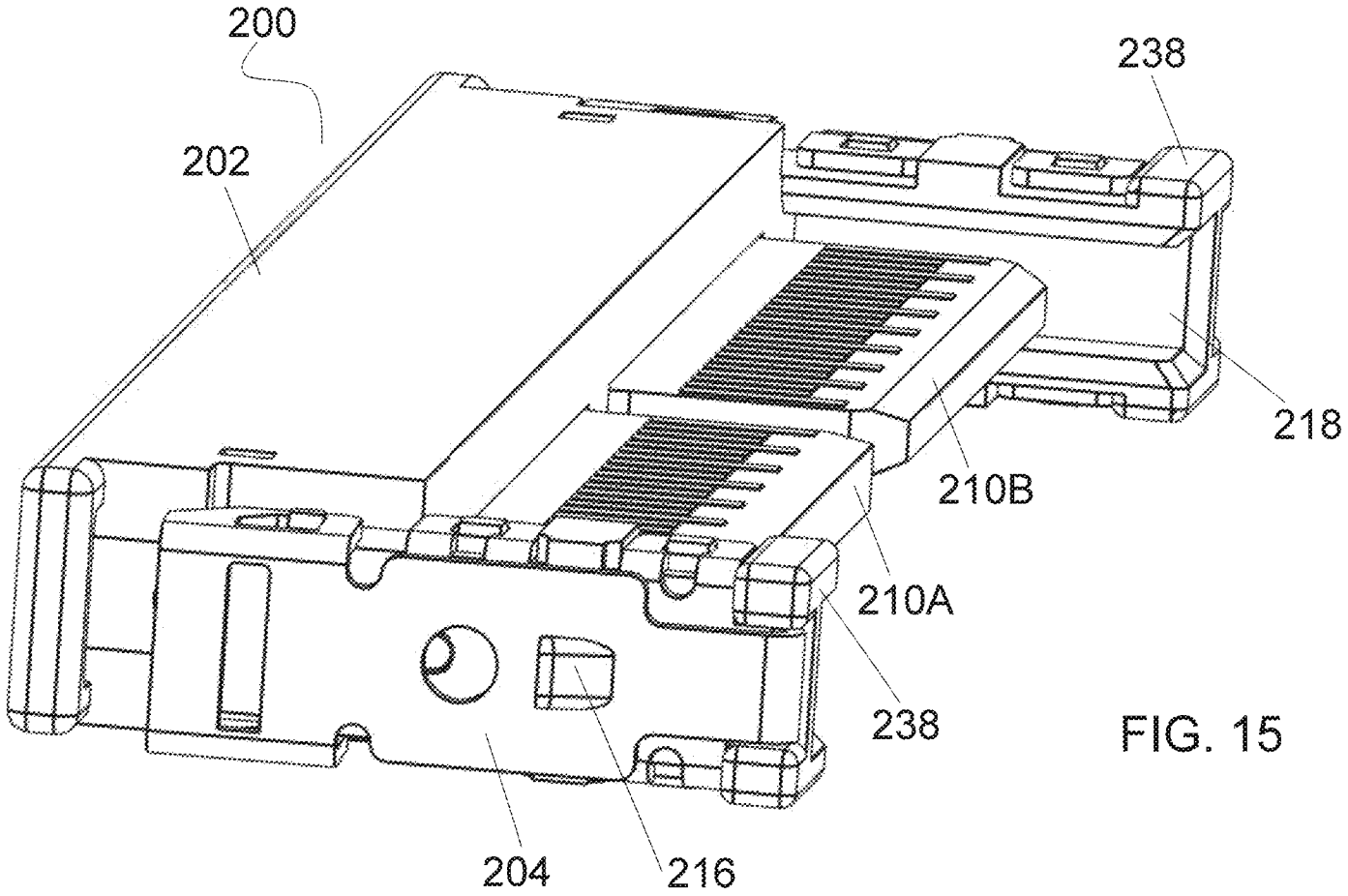
FIG. 15 is a front, left perspective view of an exemplary embodiment of a complementary plug connector configured to mate with the receptacle connector of FIG. 1.
Figure 17:
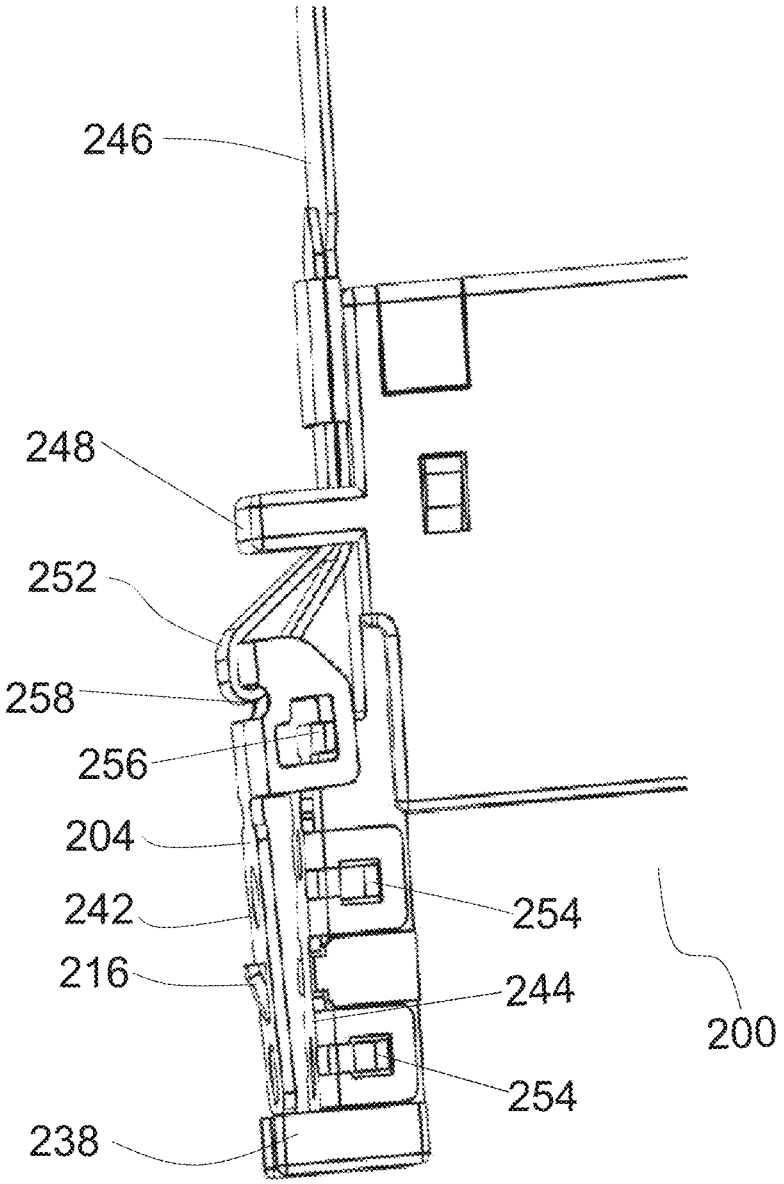
FIG. 17 is a partial enlarged view of the complementary plug connector of FIG. 15 showing a belt coupled to a deformable member.

FIG. 15 illustrates a front, left perspective view of an exemplary embodiment of a complementary connector, shown here as plug connector 200, configured for mating with receptacle connector 100. As shown in FIG. 15, plug connector 200 comprises a plug body 202, a pair of engagement arms 238, and a pair of deformable members 204. In some embodiments, plug connector further comprises an unlatching mechanism such as belt 246 (FIG. 17). Plug connector 200 may be configured to mate with receptacle connector 100 when plug connector 200 is moved in a mating direction 240.

Plug body 202 may be formed of an insulative material, such as plastic, which may be molded to provide the shape illustrated. Plug body 202 may be shaped to hold paddle cards 210A-B so as to form a mating interface.

As illustrated in FIG. 15, paddle cards 210A-B may be held in first and second slots 212A-B, respectively. Paddles cards 210A-B include pads (not numbered) that serve as mating contacts that may be contacted by mating portions 112A and 114A of receptacle connector 100. One or more cables (not shown) may extend from a side of the plug body 202 opposite the first and second slots 212A-B. Conductors within the one or more cables may be terminated to paddle cards 210A-B, making electrical contact to the pads. The end(s) of the one or more cables not terminated to plug connector 200 may be terminated to another connector or other component that may receive or generate signals passing through plug connector 200.

Figure 16:
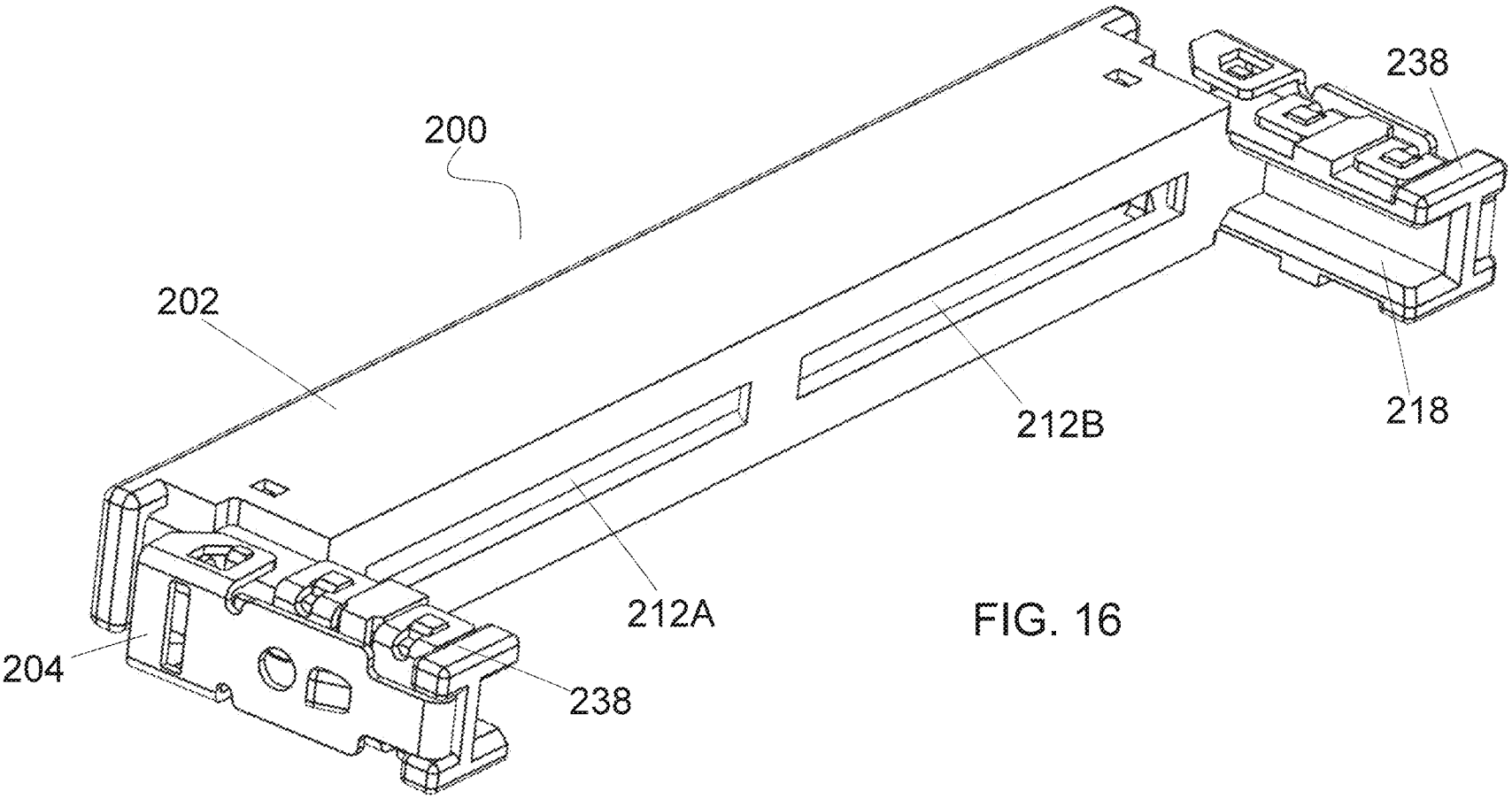
FIG. 16 is a front, left perspective view of the complementary plug connector of FIG. 15, with paddle cards shown cut away.

As illustrated in FIGS. 15-16, sides of the plug body 202 may include a pair of engagement arms 238 extending outward from the plug body 202 in the mating direction 240. The pair of engagement arms 238 may be formed as a portion of the plug body 202, such as via a molding operation. The pair of engagement arms 238 may be separately formed and then attached to the plug body 202, but in the embodiments illustrated, the pair of engagement arms 238 are integrally formed with the rest of the plug body 202.

The pair of engagement arms 238 are configured for engagement with receptacle connector 100. When the plug connector 200 is mated with the receptacle connector 100 by moving the plug connector 200 towards the receptacle connector 100 in the mating direction 240, the pair of engagement arms 238 may be configured to abut the engagement blocks 138. The pair of engagement arms 238 may comprise recesses 218 for receiving projections 118 of the receptacle connector 100 when the plug connector 200 is mated with receptacle connector 100.

Plug body 202 may comprise a pair of side tabs 248 disposed on sides of the plug body 202. An activation mechanism, such as belt 246, may be configured to pass through the side tab 248. The side tabs 248 may be formed as a portion of the plug body 202. In some embodiments, the side tabs 248 may be separately formed and then attached to the plug body 202, but in the illustrated embodiments, the side tabs 248 are integrally formed with the rest of the plug body 202.

FIG. 17 is a partial enlarged view of the plug connector 200 showing belt 246 coupled to deformable member 204. Plug connector 200 may comprise a pair of deformable members 204 coupled to the pair of engagement arms 238. Deformable members 204 may have a cantilevered configuration such that deformable members 204 comprise a fixed portion 244 and a deformable portion 242 with a hinge portion therebetween. The fixed portion 244 of deformable member 204 may be fixed to engagement arm 238. The deformable portion 242 of deformable member 204 may be configured to deflect inwardly towards the fixed portion 244. A mechanism such as a flexible pull belt 246 may be coupled to ends of the deformable portions 242 to control the inward deflection of the deformable portions 242.

Engagement arms 238 may comprising mounting points 254 and limiting points 256.

Mounting points 256 may be configured to engage with fixed portions 244 of deformable members 204 so as to fix the fixed portions 244 to engagement arms 238. Deformable portions 242 may abut the limiting points 256 when deformable portions 242 reach a point of maximum inward deflection.

As described herein, a belt 246 may be coupled to ends of deformable members 204 to control the inward deflection of deformable portions 242. Prior to the point of attachment to the deformable members 204, ends of the pull tab 403 may pass through a side tab 248 of the plug body 202. As shown in FIG. 17, after passing through the side tab 248, ends of the belt 246 may comprise a loop 252. The loop 252 may be formed by passing an end of the belt through a belt slot 258 in the deformable portion 242, then passing the end of the belt 246 up and around the outside of the loop slot 258. Ends of the belt 246 may then pass through the side tab 248 once more, before being fixed to the belt 246 to form loop 252.

When a pulling force is exerted on the belt 246 in a direction opposite a mating direction 240, belt 246 may slide through the side tab 248, drawing the distal end of deformable portion 242 downwards towards the base of side tab 248 close to the plug body 202. In this way, tension force applied to belt 246 is redirected, at least partially, into an inwards lateral direction perpendicular to the mating direction 240.

With a portion of the tension force being directed laterally inwards towards the fixed portions 244, the deformable portions 242 of the deformable members 204 deflect inwards towards the fixed portions 244 until the deformable portions 242 reach maximum inward deflection points at the limiting points 256. The inward deflection of the deformable portions 242 can thus be controlled by exerting a pulling force on the belt 246 in a direction opposite the mating direction 240.

Deformable portions 242 of deformable members 204 may comprise a latching member that engages when plug connector 200 is inserted into receptacle connector 100 and releases when deformable portions 242 deflect inwardly. Here, the latching member is illustrated as a projection 216, as shown in FIG. 15. Projection 216 is configured to be received by aperture 116 of receptacle connector 100 when plug connector 200 is mated with receptacle connector 100. Projection 216 may comprise an inclined face (not numbered) to facilitate mating with receptacle connector 100. When projection 216 is received by aperture 116, movement of the connector assembly 250 formed by the plug connector 200 and the receptacle connector 100 in a direction other than the mating direction 240 is prevented.

Figure 18:
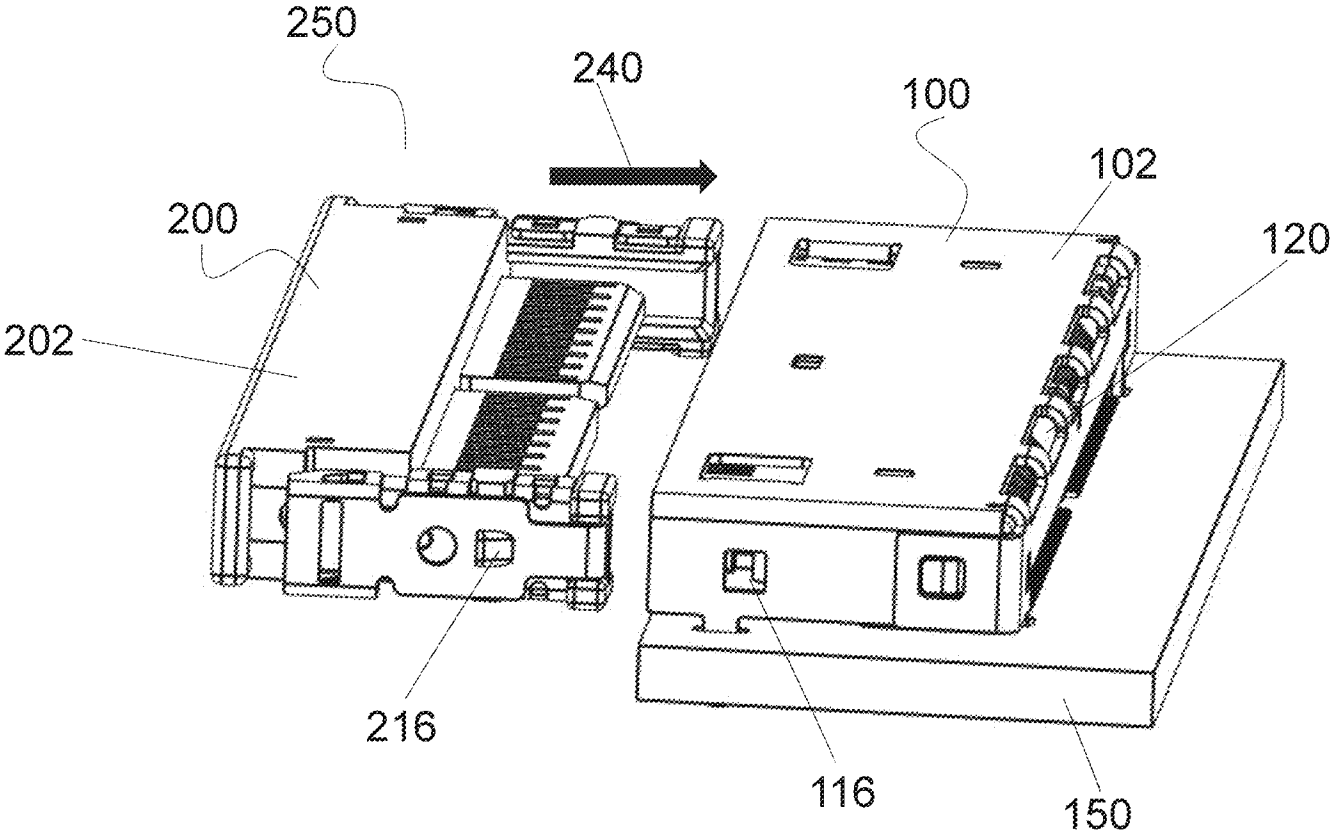
FIG. 18 is a perspective view of a connector assembly comprising the receptacle connector of FIG. 1 and the complementary plug connector of FIG. 15 in an unmated state, with the receptacle connector mounted to a substrate.
Figure 19:
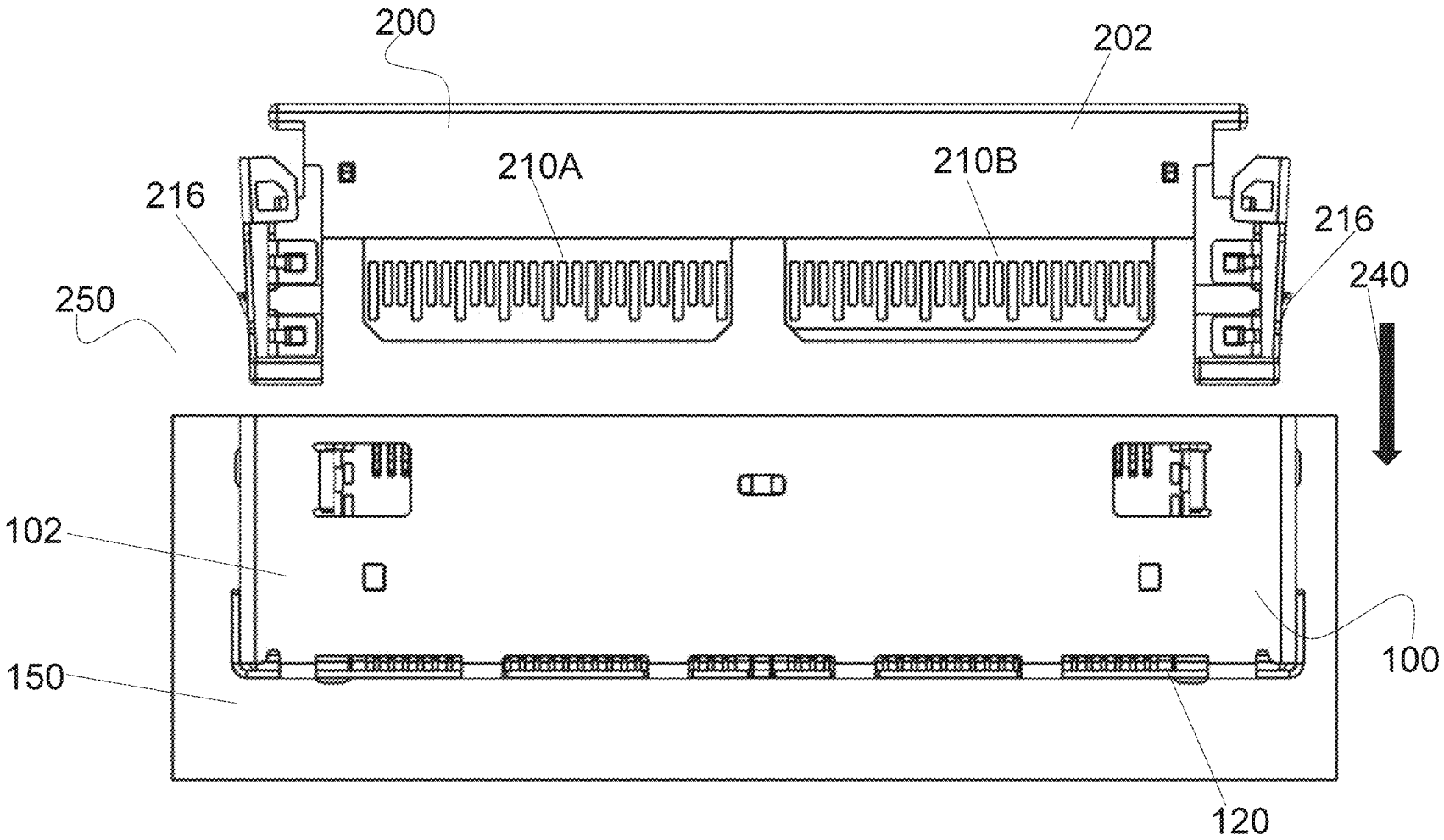
FIG. 19 is a top view of a connector assembly of FIG. 18 in an unmated state.

FIG. 18 is a perspective view of a connector assembly 250 comprising the receptacle connector 100 and the plug connector 200 according to the embodiments described herein, in an unmated state, with the receptacle connector 100 mounted to a printed circuit board 150. FIG. 19 is a top view of the connector assembly 250 in an unmated state, with the receptacle connector 100 mounted to the printed circuit board 150.

When the connector assembly 250 is in the unmated state, plug connector 200 may be aligned with the mating interface 108 of the receptacle connector 100. Plug connector 200 and receptacle connector 100 may be brought together by moving plug connector 200 towards receptacle connector 100 in the mating direction 240 such that engagement arms 238 abut engagement blocks 138 and projections 118 are received in the recesses 218 of engagement arms 238.

When plug connector 200 is moved in the mating direction 240 towards receptacle connector 100, deformable members 204 are received inside the shell 102. Side faces 130 are configured to slide over projections 216 of deformable members 204 by virtue of the inclined surface of projection 216. In doing so, deformable portions 242 of deformable members 204 are caused to deflect inwards towards the fixed portions 244 of deformable members 204 by the force exerted by side faces 130 on projections 216. When plug connector 200 has been moved sufficiently far in the mating direction 240 such that projections 216 reach apertures 116 of receptacle connector 100, the deformable portions 242 of deformable members 204 are caused to deflect outwards by a spring force generated by the cantilevered configuration of deformable members 204. The outward deflection of the deformable portions 242 of deformable members 204 cause projections 216 to be received in apertures 116 of the receptacle connector 100.

Figure 20:
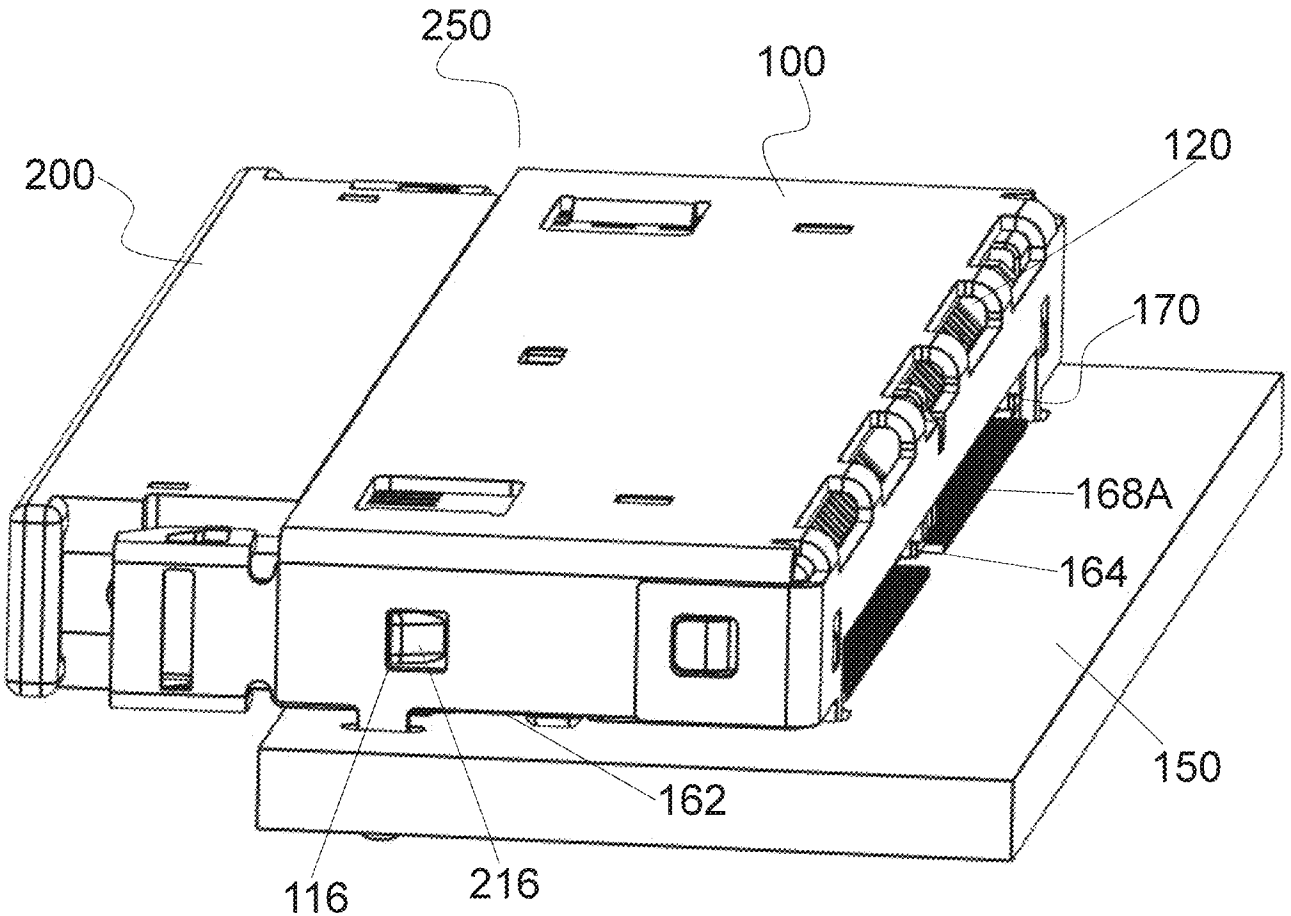
FIG. 20 is a perspective view of a connector assembly of FIG. 17 in a mated state, wherein the receptacle connector is mounted to a substrate.

FIG. 20 illustrates a perspective view of connector assembly 250 in a mated state, wherein the receptacle connector 100 is mounted to a printed circuit board 150. In the illustrated embodiment, when projections 216 are received in apertures 116 of receptacle connector 100, motion in directions other than the mating direction 240 is prevented. Further motion in the mating direction 240 may be prevented by other features, such as the projections 118 of receptacle connector 100 being received in the recesses 218 of the plug connector 200. The fit of projections 118 into recesses 218 also restrains rotation of the plug connector 200 with respect to the receptacle connector 100, protecting the mating interface 108 and ensuring reliable connections.

When it is necessary to perform unmating, deformable portions 242 of deformable members may be caused to deflect inwardly towards fixed portions 242, such as by pulling belt 246 in a direction opposite from the mating direction 240, so that projections 216 are removed from the apertures 116. With the projections 216 removed from apertures 116, motion of the plug connector 200 in a direction opposite the mating direction 240 is no longer restrained, plug connector 200 can be removed from the mating interface 108 of receptacle connector 100, and the projections 118 can be removed from the recesses 218 of engagement arms 238. As described herein, any suitable mechanism may be employed to cause deformable portions 242 to deflect inwardly, such as the flexible pull belt 246 described herein, for example. With the embodiments of the technology described herein, both mating and unmating of the connectors 100, 200 require motion parallel to the surface of the printed circuit board 150, to which receptacle connector 100 is mounted.

Figure 21:
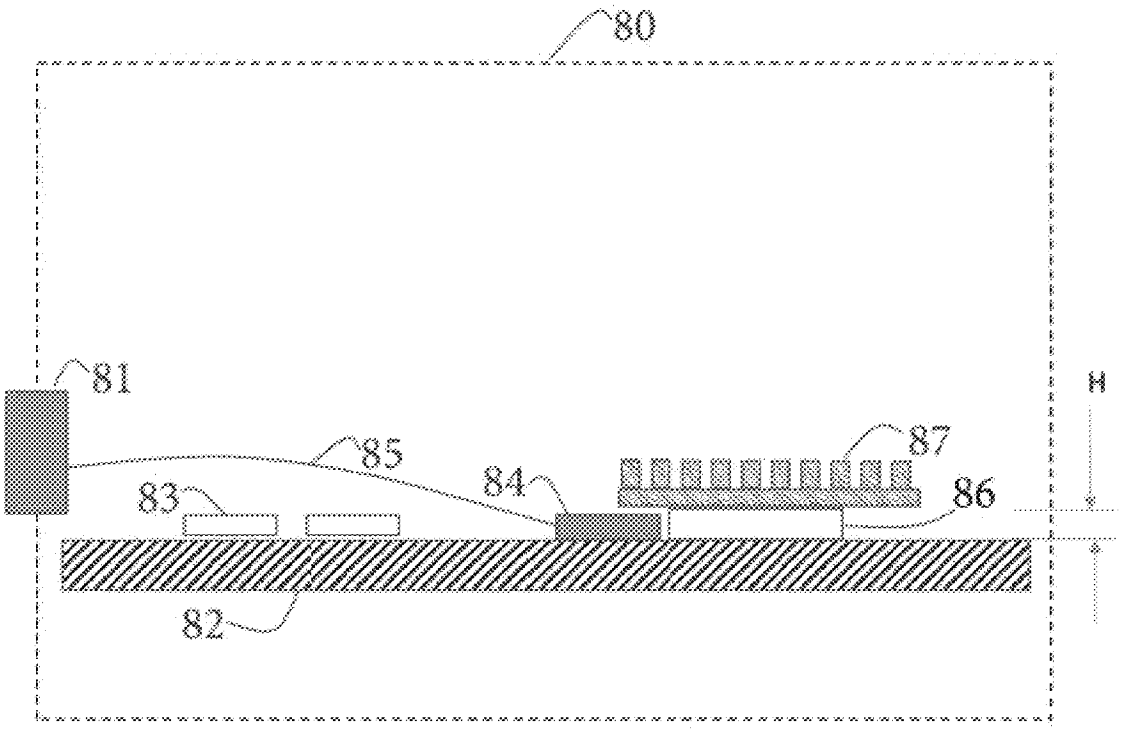
FIG. 21 is a schematic diagram of an exemplary embodiment of a compact electronic system using a connector as described herein.

Connectors 100, 200 according to embodiments of the technology described herein may have a relatively short height such as less than 5 mm, approximately 4.5 mm, approximately 4 mm, and such as between 4 and 5 mm, in some embodiments. In some embodiments, the connectors 100, 200 may be even shorter. For example, first and second slots 212A-B of plug connector 200 may be lined with mating contacts only on one side, enabling a shorter connector, such as on the order of 3.5 mm, producing a connectors having a height between 3 and 4 mm, in some embodiments. FIG. 21 illustrates how such short connectors may enable construction of a compact electronic assembly.

FIG. 21 is a schematic diagram of an exemplary embodiment of a compact electronic system/device using a connector 100 as described herein. In the embodiment illustrated, electronic device 80 includes an electronic component, such processor 86, which processes a large number of high-speed electronic signals.

Processor 86, as well as other electronic components 83, are mounted to a printed circuit board 82. Signals may be routed to and from processor 86 through traces in printed circuit board 82, as in conventional electronic systems. Some of those signals may pass in and out of electronic device 80 with I/O connector 81. Here I/O connector 81 is shown mounted in an opening of an enclosure of electronic device 80.

For some electronic devices that process high-speed signals, the amount of signal loss that occurs in a path through printed circuit board 82 from I/O connector 81 to processor 86 may be unacceptably large. Such losses might occur, for example, in an electronic system processing 56 GHz or 112 GHz signals when the path through the printed circuit board 82 is approximately 6 inches or longer.

A low loss path may be provided through cables 85. In the electronic device illustrated in FIG. 20, cable 85 connects I/O connector 81 to a connector assembly 84 mounted to printed circuit board 82 near processor 86. The distance between connector assembly 84 and processor 86 may be of the order of 1 inch or less. Connector assembly 84 may be implemented using any embodiments of the connectors as described herein. For example, receptacle connector 100 may be mounted to printed circuit board 82 adjacent processor 86. A plug connector, such as plug connector 200, may terminate cable 85. Plug connector 200 may be plugged into receptacle connector 100, creating connector assembly 84. It should be appreciated that connector assembly 84 may be created using any of the plug connector and receptacle connector embodiments described herein, and the connector assembly 84 is not limited in this respect.

FIG. 21 illustrates that a short connector assembly 84 as described herein may fit within a space that might otherwise be unusable within electronic device 80. As shown in FIG. 21, a heat sink 87 may be attached to the top of processor 86. Heatsink 87 may extend beyond the periphery of processor 86. When heat sink 87 is mounted above printed circuit board 82, there is a space between portions of heatsink 87 and printed circuit board 82. However, this space has a height H, which may be relatively small, such as 4.5 mm or less, and a conventional connector may be unable to fit within this space. A receptacle connector, such as receptacle connector 100, may fit within this space. For example, receptacle connector 100 may be mounted to printed circuit board 82 adjacent to processor 86. A plug connector 200 may be plugged into receptacle connector 200 and latched by engaging projections 216 with apertures 116, as described herein. Heatsink 87 may then be installed.

Such a configuration uses less space on printed circuit board 82 than if a connector were mounted to printed circuit board 82 outside the perimeter of heatsink 87. Such a configuration enables more electronic components 83 to be mounted to printed circuit board 82, increasing the functionality of electronic device 80. Alternatively, printed circuit board 82 may be made smaller, reducing its cost. Moreover, the integrity with which signals pass from connector assembly 84 to processor 86 may be increased relative to an electronic device in which a conventional connector is used to terminate cable 85, because the length of the signal path through printed circuit board 82 is less.

Connectors as described herein may also be used in a method of manufacturing an electronic assembly. The method may comprise the steps of: positioning a receptacle connector 100 according to any of the embodiments described herein on a printed circuit board 150; flowing heated air over mounting portions 112B, 114B of the plurality of contacts 112, 114 so as to wet the mounting portions 112B, 114B and conductive pads on the printed circuit board 150 with solder; and releasing heat from inside the shell 102 through at least one hole 120 disposed in the first bent portion 152. In some embodiments, releasing heat comprises air flow through the at least one hole 120. In some embodiments, flowing heated air over the mounting portions 112B, 114B comprises flowing the heated air through a gap 148 between the receptacle connector 100 and the printed circuit board 150.

Although the present invention has been shown and presented specifically with reference to preferred embodiments, those skilled in the art will understand that various changes in form and detail made to the present invention within the spirit and scope of the present invention as defined in the attached claims are included in the scope of protection of the present invention.

Techniques described herein may enable an electrical connector to have improved the integrity of signals over a range of high frequencies, such as frequencies up to about 56 or 120 GHz or higher, while maintaining a small connector size. That is, the mating contacts of the connector may be maintained at a high density, such as an edge to edge spacing between adjacent conductive elements of approximately 0.25 mm or less, with a center-to-center spacing between adjacent contacts in a row of between 0.5 mm and 0.8 mm. The contacts may have a width of between 0.3 mm and 0.4 mm for some types of contacts, and may have a width of between 0.65 mm and 0.75 mm for other types of contacts.

It should be understood that various alterations, modifications, and improvements may be made to the structures, configurations, and methods discussed above, and are intended to be within the spirit and scope of the invention disclosed herein.

Further, although advantages of the present invention are indicated, it should be appreciated that not every embodiment of the invention will include every described advantage. Some embodiments may not implement any features described as advantageous herein. Accordingly, the foregoing description and attached drawings are by way of example only.

It should be understood that some aspects of the present technology may be embodied as one or more methods, and acts performed as part of a method of the present technology may be ordered in any suitable way. Accordingly, embodiments may be constructed in which acts are performed in an order different than shown and/or described, which may include performing some acts simultaneously, even though shown and/or described as sequential acts in various embodiments.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Further, terms denoting direction have been used, such as "left", "right", "forward" or "up". These terms are relative to the illustrated embodiments, as depicted in the drawings, for ease of understanding. It should be understood that the components as described herein may be used in any suitable orientation.

Use of ordinal terms such as "first," "second," "third," etc., in the description and the claims to modify an element does not by itself connote any priority, precedence, or order of one element over another, or the temporal order in which acts of a method are performed, but are used merely as labels to distinguish one element or act having a certain name from another element or act having a same name (but for use of the ordinal term) to distinguish the elements or acts.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

As used herein in the specification and in the claims, the phrase "equal" or "the same" in reference to two values (e.g., distances, widths, etc.) means that two values are the same within manufacturing tolerances. Thus, two values being equal, or the same, may mean that the two values are different from one another by ±5%.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

Also, the phraseology and terminology used herein is for the purpose of description and should not be regarded as limiting. Use of terms such as "including," "comprising," "comprised of," "having," "containing," and "involving," and variations thereof herein, is meant to encompass the items listed thereafter and equivalents thereof as well as additional items.

The terms "approximately" and "about" if used herein may be construed to mean within ±20% of a target value in some embodiments, within ±10% of a target value in some embodiments, within ±5% of a target value in some embodiments, and within ±2% of a target value in some embodiments. The terms "approximately" and "about" may equal the target value.

The term "substantially" if used herein may be construed to mean within 95% of a target value in some embodiments, within 98% of a target value in some embodiments, within 99% of a target value in some embodiments, and within 99.5% of a target value in some embodiments. In some embodiments, the term "substantially" may equal 100% of the target value.

The invention claimed is:

1. A receptacle connector, comprising:

a housing comprising:

a mating interface configured to receive a plug connector, the mating interface comprising a plurality of contacts disposed in at least one row extending in a row direction, a first side, a second side, the first and second sides being disposed opposite each other and extending perpendicular to the row direction, and a slot formed on each of the first side and the second side;

a plurality of contacts disposed in the mating interface;

a shell at least partially covering the housing, the shell comprising:

first and second side faces disposed opposite each other, the first and second side faces disposed parallel to the first and second sides of the housing; and portions extending downwards from a top face of the shell and comprising tabs, each tab configured to be disposed in one of the slots formed on each of the first and the second side of the housing, the tabs being configured to prevent removal of the shell from the housing along a direction perpendicular to the row direction; and cavities disposed between the first and second sides of the housing and respective first and second side faces of the shell, wherein:

each of the cavities is configured to receive an arm of the plug connector; and each of the first and second side faces of the shell comprises an aperture configured to receive a plug projection disposed on a respective arm of the plug connector.

2. The receptacle connector of claim 1, wherein each aperture is configured to prevent unmating of the receptacle connector and the plug connector when the plug projection is received in the aperture of the first and second side faces.

3. The receptacle connector of claim 1, wherein the shell further comprises:

a rear face disposed parallel to the mating interface of the housing and perpendicular to the first and second side faces; and a top face disposed perpendicular to the mating interface of the housing and coupled between the first and second side faces of the shell, the top face of the shell being in contact with a top surface of the housing.

4. The receptacle connector of claim 3, wherein the top face is connected to the rear face by a first bent portion and connected to the first and second side faces by second bent portions.

5. The receptacle connector of claim 4, wherein the first bent portion comprises one or more holes.

6. The receptacle connector of claim 4, wherein the first bent portion is separated from the second bent portions by openings.

7. The receptacle connector of claim 1, wherein the housing comprises a mounting interface opposite the mating interface, and wherein a rear face of the shell comprises a cutout to accommodate access to the mating interface of the housing.

8. The receptacle connector of claim 7, wherein each contact of the plurality of contacts comprises a contact tail configured for connection to a substrate, wherein the contact tails of the plurality of contacts are disposed at the mounting interface of the housing and extend beyond a bottom face of the housing.

9. The receptacle connector of claim 1, wherein:

the shell is formed from a metal sheet, the shell further comprises posts extending from a rear face and each of the first and second side faces, and the posts are structured to be solder mounted in holes of a substrate.

10. The receptacle connector of claim 1, wherein a rear face of the shell comprises folding portions at opposing ends of the rear face, and the folding portions are folded onto the first and second side faces to connect the rear face to the first and second side faces.

11. The receptacle connector of claim 1, wherein the shell has a height less than 5 mm.

12. A receptacle connector, comprising:

a housing comprising:

a mating interface configured to receive at least one paddle card of a plug connector when the receptacle connector and the plug connector are mated, the mating interface comprising a plurality of contacts disposed in at least one row extending in a row direction, a first side;

a second side, the first and second sides extending perpendicular to the row direction and being disposed opposite each other with the mating interface disposed between the first and second sides; and a shell at least partially covering the housing, the shell comprising first and second side faces disposed opposite each other, the first and second side faces disposed parallel to the first and second sides of the housing; and cavities disposed between the first and second sides of the housing and respective first and second side faces of the shell, wherein:

each of the cavities is configured to receive an arm of the plug connector; and each of the first and second side faces of the shell comprises an aperture configured to receive a plug projection disposed on a respective arm of the plug connector.

13. The receptacle connector of claim 12, further comprising one or more standoffs configured to leave a gap between the receptacle connector and a substrate when the receptacle connector is mounted to the substrate.

14. The electrical assembly of claim 12, wherein:

the cavities comprise a first cavity and a second cavity;

the housing is disposed between the first cavity and the second cavity; and the mating interface is configured to receive at least one paddle card of a plug connector via at least one opening in a forward face of the housing between the first side and the second side of the housing, with the plurality of contacts exposed within the at least one opening.

15. An electrical assembly, comprising:

a receptacle connector, comprising:

a housing comprising a mating interface, a first side, and a second side, the first and second sides extending perpendicular to the mating interface and being disposed opposite each other with the mating interface disposed therebetween, wherein the mating interface is configured to receive at least one paddle card of a plug connector when the receptacle connector and the plug connector are mated;

a shell at least partially covering the housing, the shell comprising first and second side faces, the first and second side faces disposed opposite each other and parallel to the first and second sides of the housing, wherein each of the first and second side faces of the shell comprises an aperture; and cavities disposed between the first and second sides of the housing and respective first and second side faces of the shell; and the plug connector, comprising:

an insulative connector body comprising a terminal interface configured to mate with the mating interface of the receptacle connector;

insulative engagement arms extending from the insulative connector body and configured to fit within the cavities; and plug projections disposed on the insulative engagement arms, the plug projections configured to be received in the apertures of the first and second side faces of the shell of the receptacle connector.

16. The electrical assembly of claim 15, wherein the shell further comprises:

a rear face disposed parallel to the mating interface of the housing; and a top face disposed perpendicular to the mating interface of the housing and coupled between the first and second side faces of the shell, the top face of the shell being in contact with a top surface of the housing.

17. The electrical assembly of claim 16, wherein the top face is connected to the rear face by a first bent portion and connected to the first and second side faces by second bent portions.

18. The electrical assembly of claim 17, wherein the first bent portion comprises one or more holes.

19. The electrical assembly of claim 15, wherein the insulative engagement arms are configured to be received in the cavities formed between the housing and the first and second side faces of the receptacle connector.

* * * * *